US008565463B2

(12) United States Patent
Saiki et al.

(10) Patent No.: US 8,565,463 B2
(45) Date of Patent: Oct. 22, 2013

(54) LOUDSPEAKER SYSTEM

(75) Inventors: Shuji Saiki, Nara (JP); Toshiyuki Matsumura, Osaka (JP)

(73) Assignee: Panasonic Corporation, Osaka (JP)

( * ) Notice: Subject to any disclaimer, the term of this patent is extended or adjusted under 35 U.S.C. 154(b) by 309 days.

(21) Appl. No.: 12/598,317

(22) PCT Filed: Jun. 4, 2008

(86) PCT No.: PCT/JP2008/001414

§ 371 (c)(1),
(2), (4) Date: Oct. 30, 2009

(87) PCT Pub. No.: WO2008/152783

PCT Pub. Date: Dec. 18, 2008

(65) Prior Publication Data

US 2010/0135516 A1 Jun. 3, 2010

(30) Foreign Application Priority Data

Jun. 12, 2007 (JP) ..... 2007-155700

(51) Int. Cl.
*H04R 1/20* (2006.01)

(52) U.S. Cl.
USPC ..... 381/345; 381/71.7; 381/337; 381/349

(58) Field of Classification Search
USPC ..... 381/337, 349, 345, 71.7
See application file for complete search history.

(56) References Cited

U.S. PATENT DOCUMENTS

| | | | | |
|---|---|---|---|---|
| 4,718,446 A * | 1/1988 | Simpson | 137/78.3 | |
| 5,150,417 A * | 9/1992 | Stahl | 381/349 | |
| 5,327,504 A * | 7/1994 | Hobelsberger | 381/96 | |
| 7,463,747 B2 * | 12/2008 | Kuze et al. | 381/345 | |
| 2007/0127760 A1 | 6/2007 | Saiki et al. | | |
| 2007/0147645 A1 | 6/2007 | Kuze et al. | | |

FOREIGN PATENT DOCUMENTS

| | | | |
|---|---|---|---|
| JP | 57-168387 | 10/1982 | |
| JP | 5-78998 | 10/1993 | |
| JP | 2000-107550 | 4/2000 | |
| JP | 2004-343318 | 12/2004 | |
| JP | 2004-537938 | 12/2004 | |
| JP | 2006-501737 | 1/2006 | |
| WO | 84/03600 | 3/1984 | |
| WO | 2004/032567 | 4/2004 | |
| WO | WO2004032567 | * 4/2004 | |
| WO | WO 2004032567 | * 4/2004 | H04R 1/02 |
| WO | 2005/099300 | 10/2005 | |
| WO | 2005/101896 | 10/2005 | |

OTHER PUBLICATIONS

International Search Report issued Jul. 1, 2008 in International (PCT) Application No. PCT/JP2008/001414.

* cited by examiner

*Primary Examiner* — Davetta W Goins
*Assistant Examiner* — Amir Etesam
(74) *Attorney, Agent, or Firm* — Wenderoth, Lind & Ponack, L.L.P.

(57) ABSTRACT

A loudspeaker system according to the present invention includes a cabinet, a loudspeaker unit attached to an opening formed in the cabinet, a gas adsorber provided in the cabinet and operable to physically adsorb gas in the cabinet to equivalently increase a volume of an inside of the cabinet, and a dehumidifier attached to an opening formed in the cabinet and operable to discharge damp air in the cabinet to the outside when a DC voltage is applied thereto.

20 Claims, 17 Drawing Sheets

LOUDSPEAKER SYSTEM

TECHNICAL FIELD

The present invention relates to a loudspeaker system. More particularly, the present invention relates to a loudspeaker system in which a gas adsorber is provided in a cabinet.

BACKGROUND ART

Conventionally, a loudspeaker system in which a gas adsorber is provided in a cabinet has been proposed (e.g., a loudspeaker system disclosed in Patent Document 1). FIG. 19 is a partial cross-sectional view showing a main portion of a loudspeaker system 91 disclosed in Patent Document 1. The loudspeaker system 91 includes a cabinet 910, a loudspeaker unit 911, a gas adsorber 912, and a bag 913. The cabinet 910 includes a plate-shaped front wall 9101 and a curved side wall 9102. The loudspeaker unit 911 is an electrodynamic loudspeaker. The loudspeaker unit 911 is attached to the front wall 9101. The gas adsorber 912 includes a porous material having a large number of pores, such as activated carbon. The pore has a size of, for example, the order of nanometers, and therefore, can physically adsorb air. The gas adsorber 912 is enclosed in the bag 913 which is shaped in a tube. The bag 913 is provided in a curved portion of the side wall 9102 in the cabinet 910.

An operation of the loudspeaker system 91 thus configured will be described. When an electrical signal is applied to the loudspeaker unit 911, the vibration of the loudspeaker unit 911 changes air pressure in the cabinet 910. Due to the change in the air pressure, air passes through the mesh of the bag 913 and is then physically adsorbed by the gas adsorber 912 enclosed in the bag 913. As a result, the change in the air pressure in the cabinet 910 is suppressed, so that the volume of the inside of the cabinet 910 is equivalently increased. As a result, a small cabinet can reproduce low frequency sound as if the same loudspeaker unit were attached to a large cabinet.

Here, the loudspeaker system employing the gas adsorber has a problem that as humidity increases, water vapor is adsorbed by the gas adsorber, resulting in a reduction in the volume increasing effect.

Therefore, in the conventional the loudspeaker system 91, the reduction in the volume increasing effect is prevented by applying a hydrophobic treatment to the gas adsorber 912 and the bag 913.

Also, a microphone device employing a dehumidifier has been proposed as disclosed in Patent Document 2. FIG. 20 is a cross-sectional view showing a structure of a microphone device 92 disclosed in Patent Document 2. In FIG. 20, the microphone device 92 includes a container 920, a diaphragm 921, a back electrode 922, an insulating support 923, an amplifier 924, a dehumidifier 925, an insulating support 926, and a connector 927. The container 920 has openings 921h to 923h. The dehumidifier 925 includes an active device in which a porous electrode is formed on each surface of a solid electrolyte film having hydrogen ion conductivity. A DC power supply is connected to the dehumidifier 925, though it is not shown in FIG. 20.

An operation of the microphone device 92 thus configured will be described. The diaphragm 921 vibrates in accordance with an audio or music signal transferred via the opening 921h from the outside. The capacitance between the diaphragm 921 and the back electrode 922 varies due to the vibration of the diaphragm 921, and an electrical signal indicating the variation is output to the amplifier 924. The electrical signal is amplified by the amplifier 924 before being output through the connector 927. Note that the container 920 has the opening 923h so as to adjust a change in air pressure in the container 920 which is caused by a change in outside air pressure.

Here, in the conventional microphone device 92, outside damp air enters through the opening 923h for adjusting the air pressure. If the damp air reaches a space between the diaphragm 921 and the back electrode 922, noise occurs, which is a problem.

Therefore, in the conventional microphone device 92, a DC voltage is applied between the electrodes of the dehumidifier 925, which in turn performs ion decomposition, thereby discharging damp air through the opening 922h to the outside. Thus, in the conventional microphone device 92, the occurrence of noise is prevented by discharging damp air to the outside using the dehumidifier 925.

Patent Document 1: Japanese National Phase PCT Laid-Open Publication No. 2004-537938

Patent Document 2: Japanese Laid-Open Patent Publication No. 2004-343318

SUMMARY OF THE INVENTION

Problems to be Solved by the Invention

In the conventional loudspeaker system 91, a hydrophobic treatment is applied to the gas adsorber 912 and the bag 913. However, a water molecule is smaller than air molecules, and therefore, easily passes through the mesh of the bag 913 to reach the gas adsorber 912. Therefore, even if a hydrophobic treatment is applied to the bag 913, the effect of preventing the gas adsorber 912 from being damped is substantially not obtained. Also, even if a hydrophobic treatment is applied to the gas adsorber 912, the dampness preventing effect has an upper limit. Specifically, when the humidity is low, the gas adsorber 912 can be completely prevented from being damped. However, when the humidity is high and exceeds the upper limit, the gas adsorber 912 cannot be completely prevented from being damped. The humidity often exceeds the upper limit when, for example, it rains or a room is humidified by a humidifier. Thus, even if a hydrophobic treatment is applied to the gas adsorber 912 and the bag 913, the dampness preventing effect depends on ambient humidity, and therefore, the decrease in the volume increasing effect cannot be stably prevented.

Also, the dehumidifier 925 employed in the microphone device 92 is used to prevent a problem specific to microphones. The microphone-specific problem is noise which occurs as outside damp air enters the space between the diaphragm 921 and the back electrode 922. In contrast to this, the microphone-specific problem does not occur in loudspeaker systems, because a loudspeaker unit is used rather than a microphone. Therefore, in loudspeaker systems, it is not necessary to prevent the microphone-specific problem, and therefore, the dehumidifier 925 has not been employed.

An object of the present invention is to provide a loudspeaker system which employs a dehumidifier, whereby the decrease in the volume increasing effect can be stably prevented irrespective of ambient humidity.

Solution to the Problems

The present invention is directed to a loudspeaker system. To achieve the object, the loudspeaker system of the present invention includes a cabinet, a loudspeaker unit attached to an opening formed in the cabinet, a gas adsorber provided in the cabinet and operable to physically adsorb gas in the cabinet to equivalently increase a volume of an inside of the cabinet, and a dehumidifier attached to an opening formed in the cabinet and operable to discharge damp air in the cabinet to the outside when a DC voltage is applied thereto. The discharging of damp air from the dehumidifier to the outside can stably prevent a reduction in the volume increasing effect irrespective of ambient humidity.

Preferably, the loudspeaker system may further include a power supply operable to apply the DC voltage to the dehumidifier, a humidity detector operable to detect humidity in the cabinet, and a controller operable to control the power supply to apply the DC voltage to the dehumidifier only when the humidity detected by the humidity detector is higher than a predetermined threshold. As a result, it is possible to suppress the power consumption of the power supply. Note that, for example, as described in embodiments below, the humidity detector corresponds to a combination of an electrical resistance 51 and a voltage detector 52, a combination of a humidity sensor 54 and a humidity converter 55, a combination of an electrical resistance 51, a voltage detector 52, a signal source 56 and an amplifier 57, or the like.

Preferably, the humidity detector may detect a current flowing through the dehumidifier, and the controller may control the power supply to apply the DC voltage to the dehumidifier only when the current flowing through the dehumidifier is higher than a predetermined threshold. Also, the humidity detector may include an electrical resistance connected in series to the dehumidifier, and a voltage detector operable to detect a voltage between terminals of the electrical resistance, thereby detecting the current flowing through the dehumidifier, where the current is converted into the voltage.

Preferably, the humidity detector may include a humidity sensor provided in the cabinet.

Preferably, the humidity detector may detect a frequency characteristic of a current flowing through the loudspeaker unit, and the controller may control the power supply to apply the DC voltage to the dehumidifier only when a frequency at a predetermined resonance point included in the frequency characteristic is higher than a predetermined threshold. Also, the humidity detector may include an electrical resistance connected in series to the dehumidifier, and a voltage detector operable to detect a voltage between terminals of the electrical resistance, thereby detecting the frequency characteristic, where the frequency characteristic is converted into the voltage. Also, the loudspeaker system may further include an acoustic port attached to the cabinet and operable to acoustically connect an inside and an outside of the cabinet. The predetermined resonance point may be a point where acoustic resonance occurs due to an acoustic mass of the acoustic port and an acoustic compliance of an inner volume in the cabinet. Also, the loudspeaker system may further include a passive radiator attached to an opening formed in the cabinet. The predetermined resonance point may be a point where acoustic resonance occurs due to an acoustic mass of the passive radiator and an acoustic compliance of an inner volume in the cabinet.

Preferably, the loudspeaker system may further include an acoustic filter arrangement attached to an inside of the cabinet, covering the dehumidifier, and operable to cause only sounds having frequencies lower than or equal to a predetermined cut-off frequency, of sounds emitted from the loudspeaker unit into the cabinet, to reach the dehumidifier. Also, the acoustic filter arrangement may include a cover unit attached to an inside of the cabinet, covering the dehumidifier, and an acoustic port attached to an opening formed in the cover unit. Also, the acoustic filter arrangement may include a plate-shaped member provided in the cabinet with a narrow gap being interposed between the plate-shaped member and the dehumidifier. Also, the predetermined cut-off frequency may be lower than an audible frequency band.

Preferably, the loudspeaker system may further include a cushion member fixedly attached to at least a portion of the dehumidifier and permeable to air. Also, the cushion member may be made of foam rubber. Also, the cushion member may be shaped in a plate or a grid.

Preferably, the loudspeaker system may further include a partition provided in the cabinet, partitioning an inner volume in the cabinet into a first inner volume and a second inner volume, and a passive radiator attached to an opening formed in the partition. The loudspeaker unit may be provided in the first inner volume, and the gas adsorber and the dehumidifier may be provided in the second inner volume. Also, the loudspeaker system may further include an acoustic port attached to the cabinet, connecting the first inner volume and an outside of the cabinet. Also, the loudspeaker system may further include a passive radiator attached to an opening formed in the cabinet, where the opening connects the first inner volume and an outside of the cabinet.

Preferably, the loudspeaker system may further include a cover unit attached to an outer surface of the cabinet, covering the loudspeaker unit, and a passive radiator attached to an opening formed in the cover unit.

Preferably, the gas adsorber may include a porous material made of at least any one of activated carbon, zeolite, silica ($SiO_2$), alumina ($Al_2O_3$), zirconia ($ZrO_3$), magnesia ($MgO$), triiron tetroxide ($Fe_3O_4$), molecular sieve, fullerene, and carbon nanotube.

The present invention is also directed to a vehicle. To achieve the object, the vehicle of the present invention includes the loudspeaker system of the present invention, and a body in which the loudspeaker system is provided.

The present invention is also directed to a video apparatus. To achieve the object, the video apparatus of the present invention includes the loudspeaker system of the present invention, and an apparatus housing in which the loudspeaker system is provided.

The present invention is also directed to a mobile information processing device. To achieve the object, the mobile information processing device of the present invention includes the loudspeaker system of the present invention, and a device housing in which the loudspeaker system is provided.

Effect of the Invention

According to the present invention, it is possible to provide a loudspeaker system capable of stably preventing a reduction in the volume increasing effect irrespective of ambient humidity.

DESCRIPTION OF THE REFERENCE CHARACTERS

Figure 1:
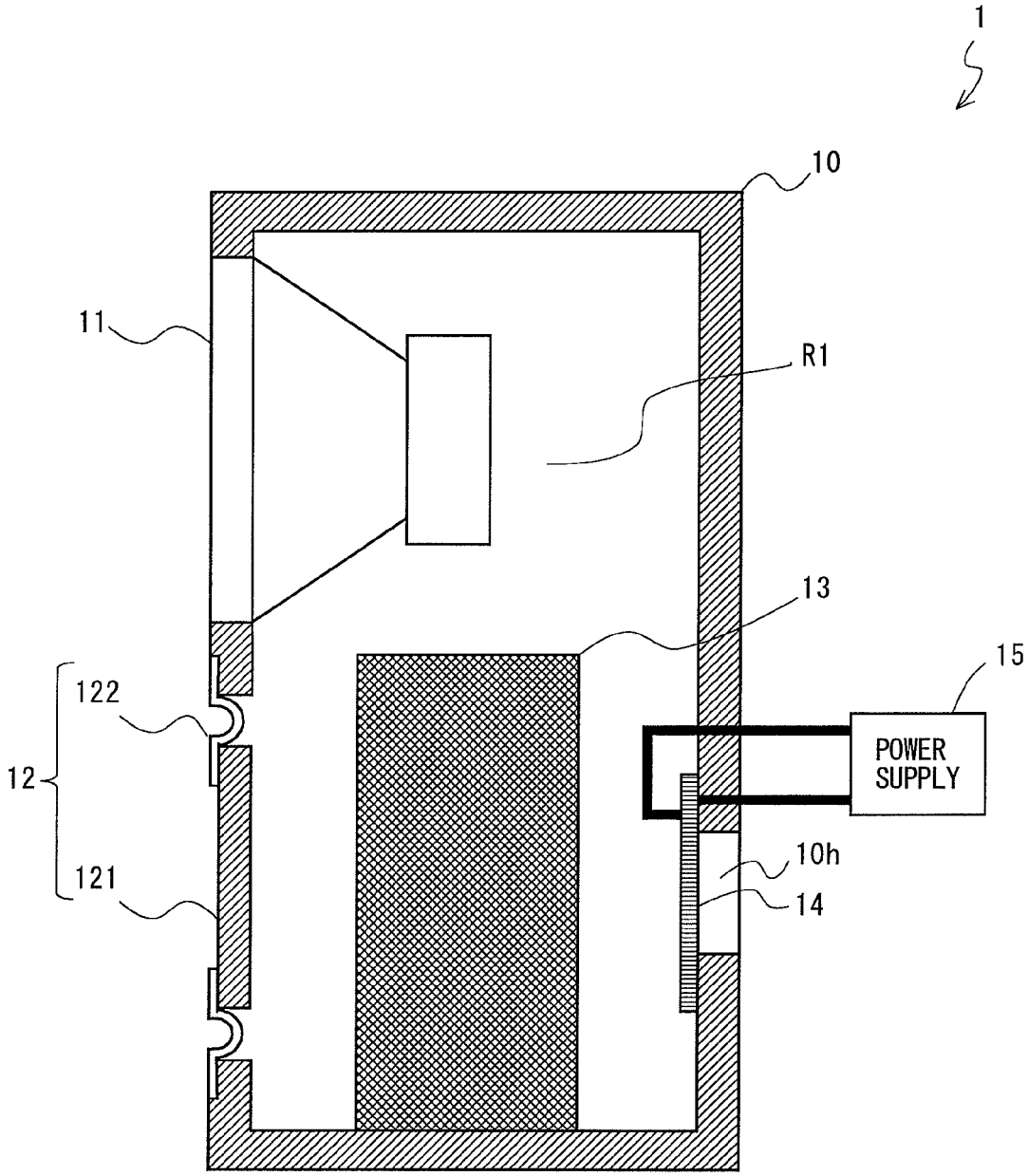
FIG. 1 is a cross-sectional view showing a structure of a loudspeaker system 1.

1 to 7, 853 loudspeaker system
10, 815, 833, 854 cabinet
11, 819, 834, 855 loudspeaker unit
12, 32, 41, 856 passive radiator
121, 321, 411, 824 diaphragm
122, 322, 412 edge
13, 816, 840, 857 gas adsorber
14, 817, 841, 858 dehumidifier
15, 818, 859 power supply
21, 21*a* acoustic filter arrangement
211, 40 cover unit
212, 30, 50 acoustic port
213 plate-shaped member
214 spacer
31 partition
33 cushion member
51 electrical resistance
52 voltage detector
53 controller
54 humidity sensor
55 humidity converter
56 signal source
57 amplifier
81 mobile telephone
811 device housing
812 hinge portion
813 liquid crystal display
814 antenna
820 yoke
821 magnet
822 plate
823 frame
825 voice coil
826 gasket
827 first dust shielding mesh
828 second dust shielding mesh
83 automobile door
831 window glass
832 door main body
835 inner wall
836 inner panel
837 outer panel
838 acoustic tube
839 grille
85 flat-panel television
851 liquid crystal display
852 apparatus housing

DETAILED DESCRIPTION OF THE INVENTION

Hereinafter, embodiments of the present invention will be described with reference to the accompanying drawings.

First Embodiment

A structure of a loudspeaker system 1 according to a first embodiment of the present invention will be described with reference to FIG. 1. FIG. 1 is a cross-sectional view showing the structure of the loudspeaker system 1. In FIG. 1, the loudspeaker system 1 includes a cabinet 10, a loudspeaker unit 11, a passive radiator 12, a gas adsorber 13, a dehumidifier 14, and a power supply 15. The loudspeaker unit 11 is an electrodynamic loudspeaker. A means for generating a driving force for the loudspeaker unit 11 is composed of a magnetic circuit and a voice coil. The loudspeaker unit 11 is attached to a front surface of the cabinet 10. The passive radiator 12, which includes a diaphragm 121 and an edge 122, is attached to the front surface of the cabinet 10. An outer periphery of the edge 122 is attached to an opening formed in the front surface of the cabinet 10, and an inner periphery of the edge 122 is attached to an outer periphery of the diaphragm 121.

The gas adsorber 13, which is provided in the cabinet 10, physically adsorbs air in the cabinet 10. The gas adsorber 13 includes a porous material in which a large number of minute pores are formed. Examples of the porous material include activated carbon, zeolite, silica ($SiO_2$), alumina ($Al_2O_3$), zirconia ($ZrO_3$), magnesia (MgO), triiron tetroxide ($Fe_3O_4$), molecular sieve, fullerene, carbon nanotube, and the like. The gas adsorber 13 may be a group of particulate porous materials or may be shaped by compacting the group. The size of the pore formed in the gas adsorber 13 is, for example, of the order of nanometers, and therefore, the pore can physically adsorb air.

Note that the gas adsorber 13 may be a material which can physically adsorb gas other than air if it can equivalently increase the volume of the inside of the cabinet 10. In other words, the gas adsorber 13 may be a material which can physically adsorb gas in the cabinet 10 and can increase the volume of the inside of the cabinet 10.

The dehumidifier 14 includes an active device having a porous electrode formed on each surface of a solid electrolyte film having hydrogen ion conductivity. When a DC voltage is applied between the electrodes of the dehumidifier 14, damp air is decomposed into oxygen ions and hydrogen ions. Each electrode of the dehumidifier 14 is connected to the power supply 15, and a DC voltage is applied from the power supply 15 to each electrode. The dehumidifier 14 is attached to an opening 10*h* formed in a back surface of the cabinet 10.

Specifically, the dehumidifier 14 is attached to an inner surface of the cabinet 10, covering the opening 10*h*. When the DC voltage is applied between the electrodes of the dehumidifier 14, damp air in an inner volume R1 is discharged through the opening 10*h* to the outside of the cabinet 10 by the decomposition action of the dehumidifier 14. Also, when humidity in the inner volume R1 is decreased by discharging damp air in the inner volume R1 to the outside, then even if there are water molecules physically adsorbed by the gas adsorber 13, the water molecules can be released from the gas adsorber 13. In other words, by decreasing the humidity in the inner volume R1, the reduction in the volume increasing effect of the gas adsorber 13 can be suppressed, and in addition, the volume increasing effect of the gas adsorber 13 can be restored (revived).

An operation of the loudspeaker system 1 thus configured will be described. The loudspeaker unit 11 is a typical electrodynamic loudspeaker, and therefore, its operation is well known and will not be described in detail. When a music signal is applied to the loudspeaker unit 11, a driving force is generated in the voice coil to vibrate the diaphragm, thereby generating sounds from the front and back surfaces of the diaphragm. The sound from the back surface is emitted into the inner volume R1, so that acoustic resonance occurs due to the mass of the passive radiator 12 and the acoustic compliance of the inner volume R1. Also, the sound from the back surface changes air pressure in the inner volume R1. Here, the gas adsorber 13 which physically adsorbs air is provided in the inner volume R1. Therefore, the change in the air pressure in the inner volume R1 is suppressed. In other words, the acoustic compliance of the inner volume R1 is increased by the physical air adsorption action of the gas adsorber 13. As a result, the volume of the inside of the inner volume R1 is equivalently increased, and therefore, the loudspeaker system 1 operates as if the passive radiator 12 were attached to a cabinet which has a volume larger than that of the cabinet 10. By this operation, the loudspeaker system 1 can reproduce low frequency sound even using a small cabinet as if the same loudspeaker unit were attached to a large cabinet.

Here, the ambient humidity of the loudspeaker system 1 is increased when it rains or when a humidifier or the like is used in a room where the loudspeaker system 1 is installed. In this case, damp air enters the inner volume R1 through the loudspeaker unit 11 or the passive radiator 12, so that humidity in the inner volume R1 is also increased. However, the decomposition action of the dehumidifier 14 in which the DC voltage is applied between the electrodes, discharges damp air in the inner volume R1 through the opening 10*h* to the outside of the cabinet 10. As a result, the humidity in the inner volume R1 is decreased, and therefore, the reduction in the volume increasing effect due to the physical adsorption of damp air into the gas adsorber 13 can be stably suppressed. Also, when water molecules are already physically adsorbed in the gas adsorber 13, the volume increasing effect of the gas adsorber 13 can be revived.

Figure 2:
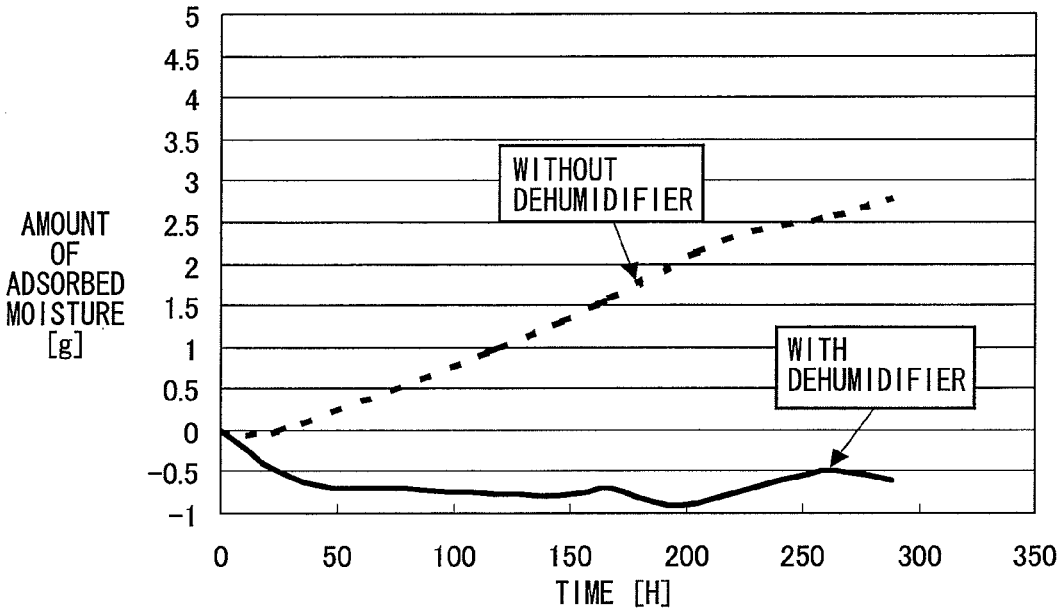
FIG. 2 is a diagram showing the result of measurement of the weight of damp air physically adsorbed by a gas adsorber 13.

The results of measurement of the weight of damp air physically adsorbed by the gas adsorber 13 (the amount of adsorbed moisture) in the presence and absence of the dehumidifier 14 are shown in FIG. 2. In the measurement of FIG. 2, the loudspeaker unit 11 having a diameter of 8 cm was used. The diaphragm and the edge of the loudspeaker unit 11 were made of a resin material and a rubber material, respectively. The diaphragm 121 and the edge 122 of the passive radiator 12 were made of a resin material and a rubber material, respectively. The cabinet 10 was made of a resin material, and the volume of the inside of the cabinet 10 was 1.3 liter. The gas adsorber 13 was a cotton bag stuffed with activated carbon particles having a diameter of about 0.35 mm (weight: 60 g), which has the action of physically adsorbing air, which is appropriate for loudspeakers, unlike commercially available typical odor absorbers or moisture absorbers, which substantially do not have the action of physically adsorbing air. The dehumidifier 14 has an outer diameter of 5 mm×5 mm. The DC voltage applied from the power supply 15 was 3 V. Under the aforementioned conditions, the loudspeaker system 1 was placed in a test chamber having a humidity of 95%, where the initial temperature of the inner volume R1 was 55° C. The weight of the gas adsorber 13 was measured at predetermined time intervals. A change in the weight was defined as the amount of adsorbed moisture.

It can be seen from FIG. 2 that, in the absence of the dehumidifier 14, the weight of the gas adsorber 13 after about 300 hours was increased by about 2.5 g as compared to the initial weight. On the other hand, in the presence of the dehumidifier 14, the weight of the gas adsorber 13 after about 300 hours was decreased as compared to the initial weight. This means that water molecules which had already been physically adsorbed by the gas adsorber 13 were released. As can be seen from this result, when the dehumidifier 14 is provided, even if the loudspeaker system 1 is placed in a high humidity environment of 95%, the gas adsorber 13 can maintain its initial state in which water molecules (damp air) are not physically adsorbed.

As described above, according to this embodiment, by employing the dehumidifier 14, it is possible to provide a loudspeaker system capable of stably preventing a reduction in the volume increasing effect irrespective of ambient humidity.

Although a passive radiator type loudspeaker system is provided in this embodiment, a closed-box type one without the passive radiator 12 may be provided. In this case, as the passive radiator 12 is not used, the hermeticity is further increased, whereby dehumidification can be more efficiently achieved by the dehumidifier 14.

Second Embodiment

Figure 3:
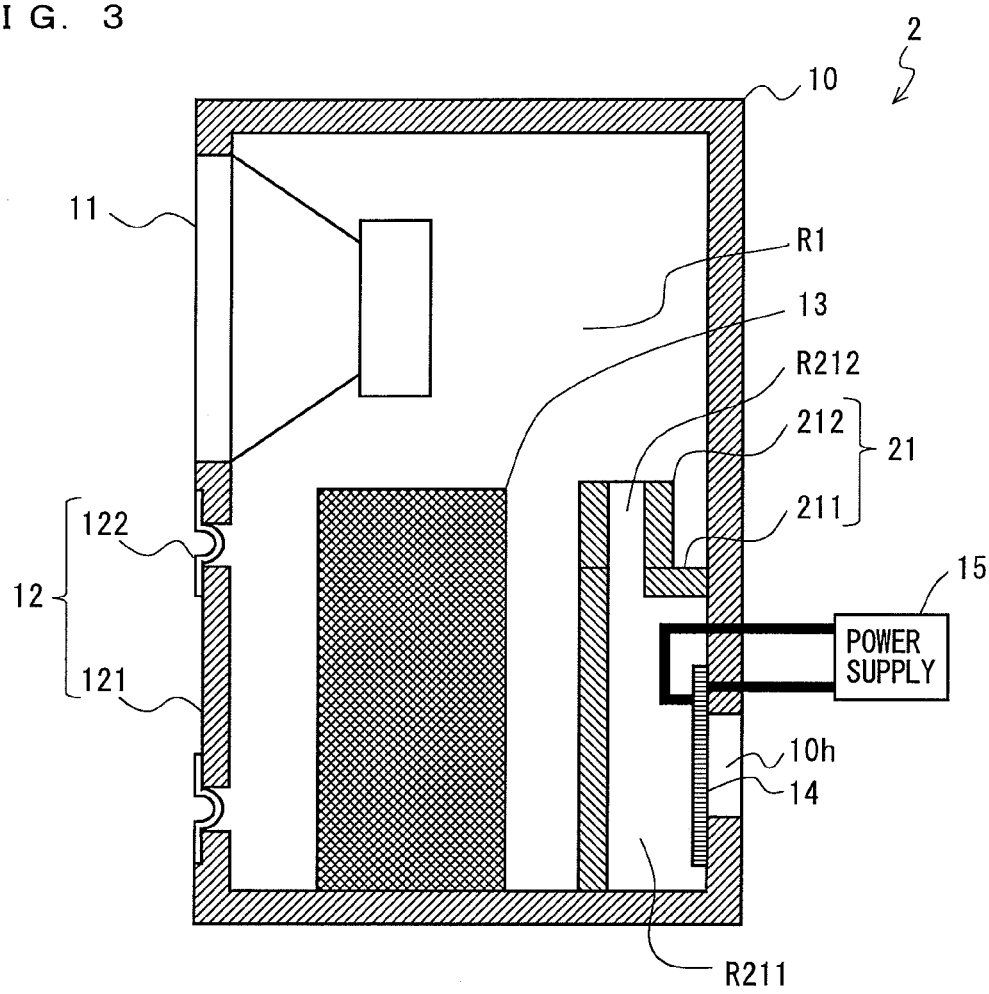
FIG. 3 is a cross-sectional view showing a structure of a loudspeaker system 2.

A structure of a loudspeaker system 2 according to a second embodiment of the present invention will be described with reference to FIG. 3. FIG. 3 is a cross-sectional view showing the structure of the loudspeaker system 2. In FIG. 3, the loudspeaker system 2 includes a cabinet 10, a loudspeaker unit 11, a passive radiator 12, a gas adsorber 13, a dehumidifier 14, a power supply 15, and an acoustic filter arrangement 21.

The loudspeaker system 2 is different from the loudspeaker system 1 only in that the acoustic filter arrangement 21 is further provided. The other parts of the loudspeaker system 2 are the same as those of the loudspeaker system 1, and therefore, are indicated by the same reference characters and will not be described.

The acoustic filter arrangement 21 is composed of a cover unit 211 forming an inner volume 8211 therein and an acoustic port 212 forming an inner volume 8212 therein. The cover unit 211 is attached to an inner surface of the cabinet 10 in a manner which allows the dehumidifier 14 to be placed in the inner volume R211. The acoustic port 212 is attached to an opening formed in the cover unit 211. The acoustic filter arrangement 21 uses the acoustic port 212 and the cover unit 211 to function as an acoustic low-pass filter. The acoustic filter arrangement 21 passes only sounds having frequencies lower than or equal to a predetermined cut-off frequency, of the sounds from the back surface of the loudspeaker unit 11.

An operation of the loudspeaker system 2 thus configured will be described. When a music signal is applied to the loudspeaker unit 11, a driving force is generated in the voice coil to vibrate the diaphragm, which in turn generates sounds from its front and back surfaces. The sound from the back surface changes air pressure in the inner volume R1. However, the change in the air pressure is suppressed by the physical air adsorption action of the gas adsorber 13. As a result, the volume of the inside of the inner volume R1 is equivalently increased. Also, the DC voltage is applied between the electrodes of the dehumidifier 14, so that damp air in the inner volume R1 is discharged through the opening 10*h* to the outside of the cabinet 10. The operation above is similar to that of the loudspeaker system 1.

Here, the loudspeaker system 1 has a structure that the sound from the back surface of the loudspeaker unit 11 is directly transferred to the dehumidifier 14. Therefore, in the loudspeaker system 1, there is a risk of damage on the dehumidifier 14 due to a high sound pressure from the back surface. On the other hand, the loudspeaker system 2 has a structure that the sound from the back surface of the loudspeaker unit 11 passes through the acoustic filter arrangement 21 before reaching the dehumidifier 14. Therefore, by appropriately setting the cut-off frequency of the acoustic filter arrangement 21, a frequency band possessed by a typical music signal (e.g., a frequency band of 40 Hz or higher) can be attenuated, whereby a sound pressure transferred to the surface of the dehumidifier 14 can be reduced. As a result, it is possible to avoid the risk of damage on the dehumidifier 14 during reproduction of music. Note that the frequency band possessed by a typical music signal is a frequency band having audible frequencies and higher. Therefore, sounds of the frequency band possessed by a typical music signal can be attenuated by setting the cut-off frequency to be lower than the audible frequency band.

Note that damp air in the inner volume R1 does not contain a frequency component (i.e., a frequency component near zero Hz is contained), and therefore, easily passes through the acoustic filter arrangement 21 and reaches the dehumidifier 14. In other words, damp air in the inner volume R1 is discharged to the outside by the dehumidifier 14 without being affected by the acoustic filter arrangement 21.

Note that the presence or absence of the necessity of the acoustic filter arrangement 21 should be determined, depending on the volume of the cabinet 10, the diameter of the loudspeaker unit 11 or the like. In the loudspeaker system 1, although the acoustic filter arrangement 21 is not provided, the effect of suppressing the change in the air pressure in the inner volume R1 by the gas adsorber 13 reduces sound pressure transferred to the dehumidifier 14 as compared to a loudspeaker system which does not include the gas adsorber 13. Therefore, if there is not a risk of damage on the dehumidifier 14 by the sound pressure suppressed by the gas adsorber 13, the acoustic filter arrangement 21 is not required. On the other hand, if there is a risk of damage on the dehumidifier 14 irrespective of the sound pressure suppressed by the gas adsorber 13, the acoustic filter arrangement 21 is required.

As described above, in this embodiment, the acoustic filter arrangement 21 is further provided, whereby the risk of damage on the dehumidifier 14 can be avoided even when a high sound pressure is transferred to the dehumidifier 14.

Figure 4:
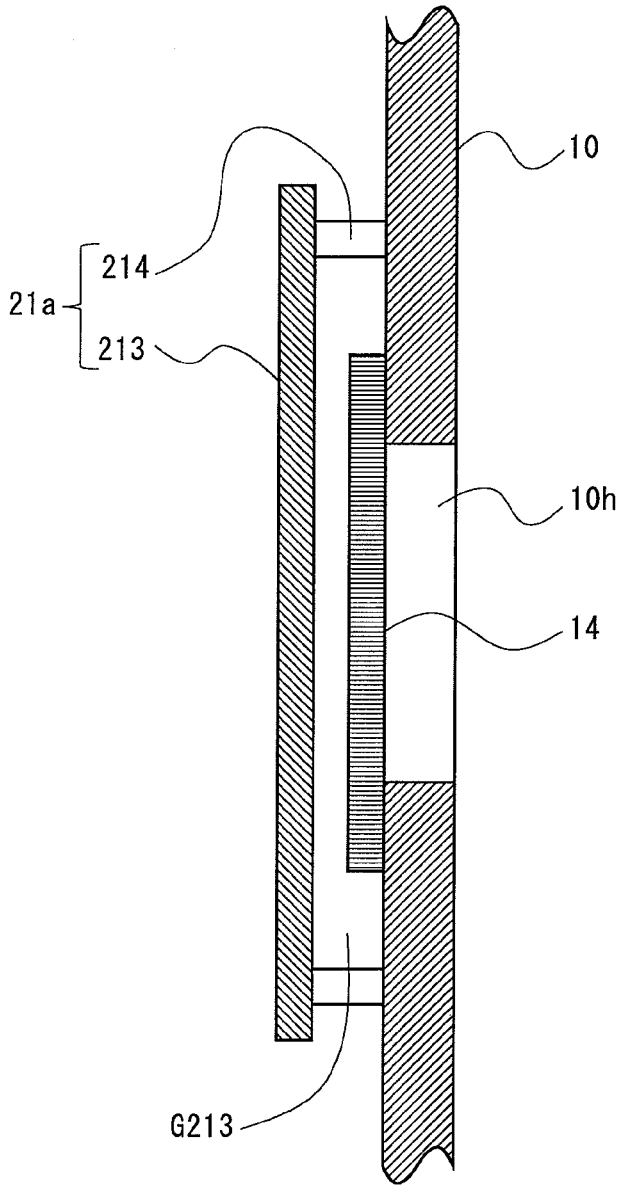
FIG. 4 is a diagram showing another exemplary structure of an acoustic filter arrangement.

Although it has been assumed above that the acoustic filter arrangement 21 is composed of the cover unit 211 and the acoustic port 212, the present invention is not limited to this. The acoustic filter arrangement 21 may have, for example, a structure shown in FIG. 4. FIG. 4 is a diagram showing another exemplary structure of the acoustic filter arrangement. FIG. 4 shows only a portion in the vicinity of the dehumidifier 14 of the loudspeaker system 2 shown in FIG. 3. In FIG. 4, the acoustic filter arrangement 21*a* is composed of a plate-shaped member 213 and a spacer 214. The plate-shaped member 213 is provided in front of the dehumidifier 14 with the spacer 214 being interposed therebetween. A narrow gap G213 having a width of, for example, 1 mm or less is formed between the plate-shaped member 213 and the dehumidifier 14. The width of the narrow gap G213 is so narrow that the viscous drag of air in the narrow gap G213 is considerably large. Therefore, the sound from the back surface of the loudspeaker unit 11 is attenuated when passing through the narrow gap G213. Note that the viscous drag of air is a resistance against sounds, which have frequency components. The magnitude of the viscous drag varies depending on the frequency. The magnitude of the viscous drag of the air is also determined by the width of the narrow gap G213. Note that the cut-off frequency of the acoustic filter arrangement 21*a* is determined by the width of the narrow gap G213. Therefore, the cut-off frequency may be determined by adjusting the width of the gap G213 so that a large viscous drag is obtained for frequencies higher than or equal to frequency components contained in a music signal. Note that damp air in the inner volume R1 does not have a frequency component and therefore is not affected by the viscous drag of the air, and therefore, easily passes through the acoustic filter 21*a* and reaches the dehumidifier 14.

Third Embodiment

Figure 5:
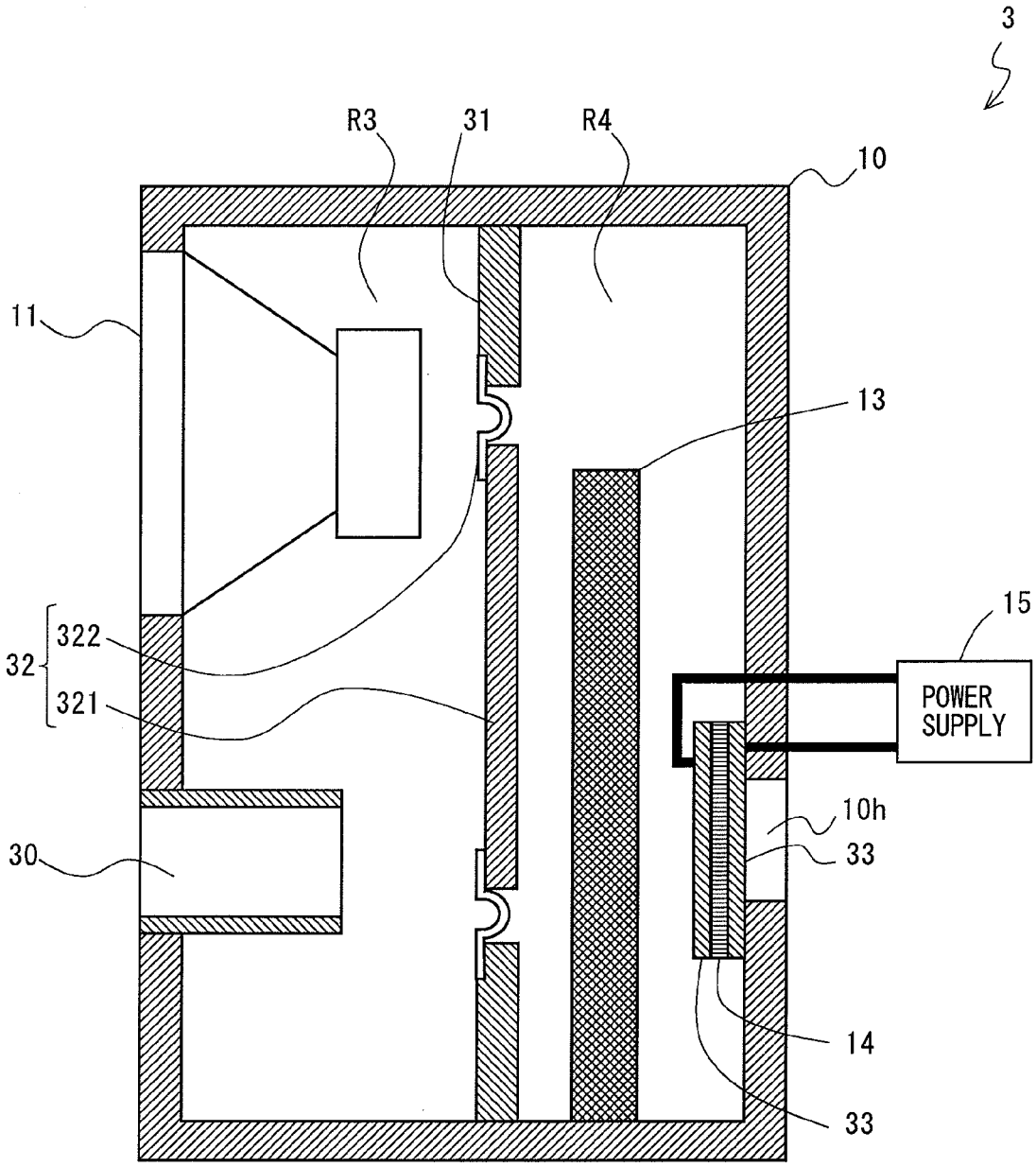
FIG. 5 is a cross-sectional view showing a structure of a loudspeaker system 3.

A structure of a loudspeaker system 3 according to a third embodiment of the present invention will be described with reference to FIG. 5. FIG. 5 is a cross-sectional view showing the structure of the loudspeaker system 3. In FIG. 5, the loudspeaker system 3 includes a cabinet 10, a loudspeaker unit 11, a gas adsorber 13, a dehumidifier 14, a power supply 15, an acoustic port 30, a partition 31, a passive radiator 32, and a cushion member 33.

The loudspeaker system 3 is different from the loudspeaker system 1 only in that the passive radiator 12 is replaced with the acoustic port 30, and the partition 31, the passive radiator 32 and the cushion member 33 are further provided. The other parts of the loudspeaker system 3 are similar to those of the loudspeaker system 1, and therefore, are indicated by the same reference characters and will not be described.

The acoustic port 30 is attached to a front surface of the cabinet 10. The partition 31 is attached to an inside of the cabinet 10 to partition an inner volume in the cabinet 10 into an inner volume R3 and an inner volume R4. The passive radiator 32, which includes a diaphragm 321 and an edge 322, is attached to an opening formed in the partition 31. The edge 322 is made of, for example, a urethane rubber material. An outer periphery of the edge 322 is attached to the opening formed in the partition 31, and an inner periphery of the edge 322 is attached to an outer periphery of the diaphragm 321. The gas adsorber 13 is provided in the inner volume R4. The cushion member 33, which is made of an air-permeable foam rubber material or the like and is shaped in a plate, is fixedly attached to an entire surface of each electrode of the dehumidifier 14. The dehumidifier 14 is provided in the cabinet 10 while being sandwiched by the cushion member 33.

An operation of the loudspeaker system 3 thus configured will be described. When a music signal is applied to the loudspeaker unit 11, a driving force is generated in the voice coil to vibrate the diaphragm, which in turn generates sounds from its front and back surfaces. The sound from the back surface is emitted into the inner volume R3, so that the diaphragm 321 is vibrated. Sound pressure generated by the vibration of the diaphragm 321 changes air pressure in the inner volume R4. However, the gas adsorber 13 is provided in the inner volume R4. Therefore, the physical air adsorption action of the gas adsorber 13 suppresses the change in the air pressure in the inner volume R4, so that the volume of the inside of the inner volume R4 is equivalently increased. Also, the loudspeaker system 3 operates as a bass-reflex type loudspeaker system due to the acoustic port 30, whereby rich low frequency sound can be reproduced.

The dehumidifier 14 is provided in the cabinet 10 while being sandwiched by the cushion member 33. Therefore, even if high sound pressure is transferred to the dehumidifier 14, so that the dehumidifier 14 is vibrated, the vibration is attenuated by the cushion member 33. As a result, it is possible to prevent the dehumidifier 14 from being damaged. As the cushion member 33 is an air-permeable material, damp air in the inner volume R3 can pass through the cushion member 33 and reach the dehumidifier 14.

As described above, according to this embodiment, the partition 31 and the passive radiator 32 are provided, and therefore, even if the acoustic port 30 is employed, external damp air can be prevented from directly contacting the gas adsorber 13. As a result, as compared to when external damp air directly contacts the gas adsorber 13, the amount of damp air physically adsorbed by the gas adsorber 13 can be significantly reduced.

Also, in this embodiment, the cushion member 33 is provided, whereby the dehumidifier 14 can be prevented from being damaged.

Although it has been assumed in this embodiment that the loudspeaker system 3 is of a bass-reflex type employing the acoustic port 30, the present invention is not limited to this. The passive radiator 12 of FIG. 1 may be provided instead of the acoustic port 30. Alternatively, the loudspeaker system 3 may be of a closed-box type where none of the acoustic port 30 and the passive radiator 12 is used. When the passive radiator 12 is provided or when the loudspeaker system 3 is of the closed-box type, external damp air enters the inner volume R4 via the loudspeaker unit 11 or the passive radiator 12, and the passive radiator 32. On the other hand, in the loudspeaker system 1, external damp air enters the inner volume R1 only via the loudspeaker unit 11 or the passive radiator 12. Therefore, by providing the passive radiator 32, the amount of damp air entering the inner volume R4 can be significantly reduced as compared to the loudspeaker system 1. This reduction also decreases a load on the operation of the dehumidifier 14.

Also, although it has been assumed in this embodiment that the cushion member 33 is shaped in a plate, the present invention is not limited to this. The cushion member 33 may be shaped in a grid (or a mesh). Also in this case, the vibration of the dehumidifier 14 is suppressed. Also, although it has been assumed in FIG. 5 that the cushion member 33 is fixedly attached to an entire surface of each electrode of the dehumidifier 14, the cushion member 33 may be fixedly attached to only a portion of the surface. Also in this case, the vibration of the dehumidifier 14 is suppressed.

Fourth Embodiment

Figure 6:
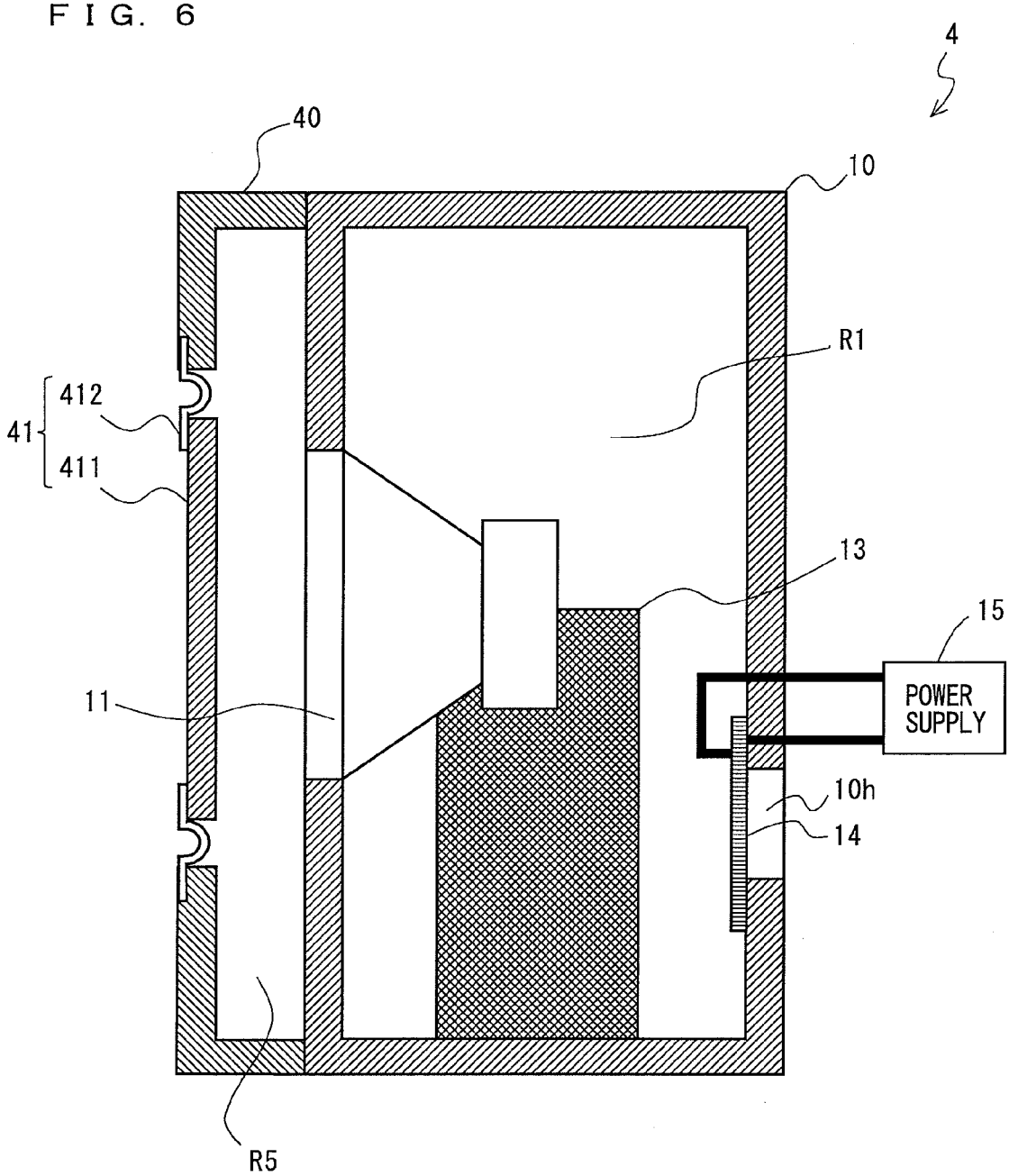
FIG. 6 is a cross-sectional view showing a structure of a loudspeaker system 4.

A structure of a loudspeaker system 4 according to a fourth embodiment of the present invention will be described with reference to FIG. 6. FIG. 6 is a cross-sectional view showing the structure of the loudspeaker system 4. In FIG. 6, the loudspeaker system 4 includes a cabinet 10, a loudspeaker unit 11, a gas adsorber 13, a dehumidifier 14, a power supply 15, a cover unit 40, and a passive radiator 41.

The loudspeaker system 3 is different from the loudspeaker system 1 only in that the passive radiator 12 is removed, the loudspeaker unit 11 is attached to a different position, and the cover unit 40 and the passive radiator 41 are further provided. The other parts of the loudspeaker system 3 are similar to those of the loudspeaker system 1, and therefore, are indicated by the same reference characters and will not be described.

The loudspeaker unit 11 is attached to an opening formed in a middle of a front surface of the cabinet 10. The cover unit 40 is attached to an outer surface of the cabinet 10, covering a front surface of the loudspeaker unit 11. The passive radiator 41, which includes a diaphragm 411 and an edge 412, is attached to an opening formed in the cover unit 40. An outer periphery of the edge 412 is attached to the opening formed in a front surface of the cover unit 40, and an inner periphery of the edge 412 is attached to an outer periphery of the diaphragm 411. An inner volume R5 is formed between the cover unit 40 and the passive radiator 41, and the front surface of the loudspeaker unit 11.

An operation of the loudspeaker system 4 thus configured will be described. When a music signal is applied to the loudspeaker unit 11, a driving force is generated in the voice coil to vibrate the diaphragm. This vibration changes air pressure in the inner volumes R1 and R5. The passive radiator 41 is vibrated due to a change in the air pressure in the inner volume R5. The change in the air pressure in the inner volume R1 is suppressed by the gas adsorber 13 provided in the inner volume R1, so that the volume of the inside of the inner volume R1 is equivalently increased. The DC voltage is applied between the electrodes of the dehumidifier 14, whereby damp air in the inner volume R1 is discharged through the opening 10*h* to the outside of the cabinet 10.

The volume increasing effect of the gas adsorber 13 enables the loudspeaker unit 11 to operate as if it were attached to an inner volume having a larger volume than that of the inner volume R1. Therefore, the passive radiator 41 is driven by the loudspeaker unit 11 in a lower frequency band as well. As a result, a loudspeaker system having an extended low-frequency reproduction band is achieved.

Note that, in the loudspeaker system 3, sound emitted from the front surface of the loudspeaker unit 11 and sound emitted from the acoustic port 30 have opposite phases in a frequency band lower than or equal to the resonant frequency of the acoustic port 30. As a result, the sound emitted from the front surface of the loudspeaker unit 11 is canceled, whereby reproduction of a low frequency sound range is hindered. In contrast to this, in the loudspeaker system 4, sound is emitted only from the front surface of the passive radiator 41. Therefore, in the loudspeaker system 4, sound is not canceled as is different from the loudspeaker system 3, and therefore, reproduction of a low frequency sound range is excellent.

Also, in the loudspeaker system 4, external damp air enters the inner volume R1 through the passive radiator 41 and the loudspeaker unit 11. On the other hand, in the loudspeaker system 1, external damp air enters the inner volume R1 only through the loudspeaker unit 11. Therefore, the amount of damp air entering the inner volume R1 in the loudspeaker system 4 is significantly reduced as compared to the loudspeaker system 1. This reduction also decreases a load on the operation of the dehumidifier 14.

As described above, in this embodiment, the cover unit 40 and the passive radiator 41 are further provided, whereby the amount of damp air entering the inner volume R1 can be reduced while excellent reproduction of a low frequency sound range is achieved.

Fifth Embodiment

Figure 7:
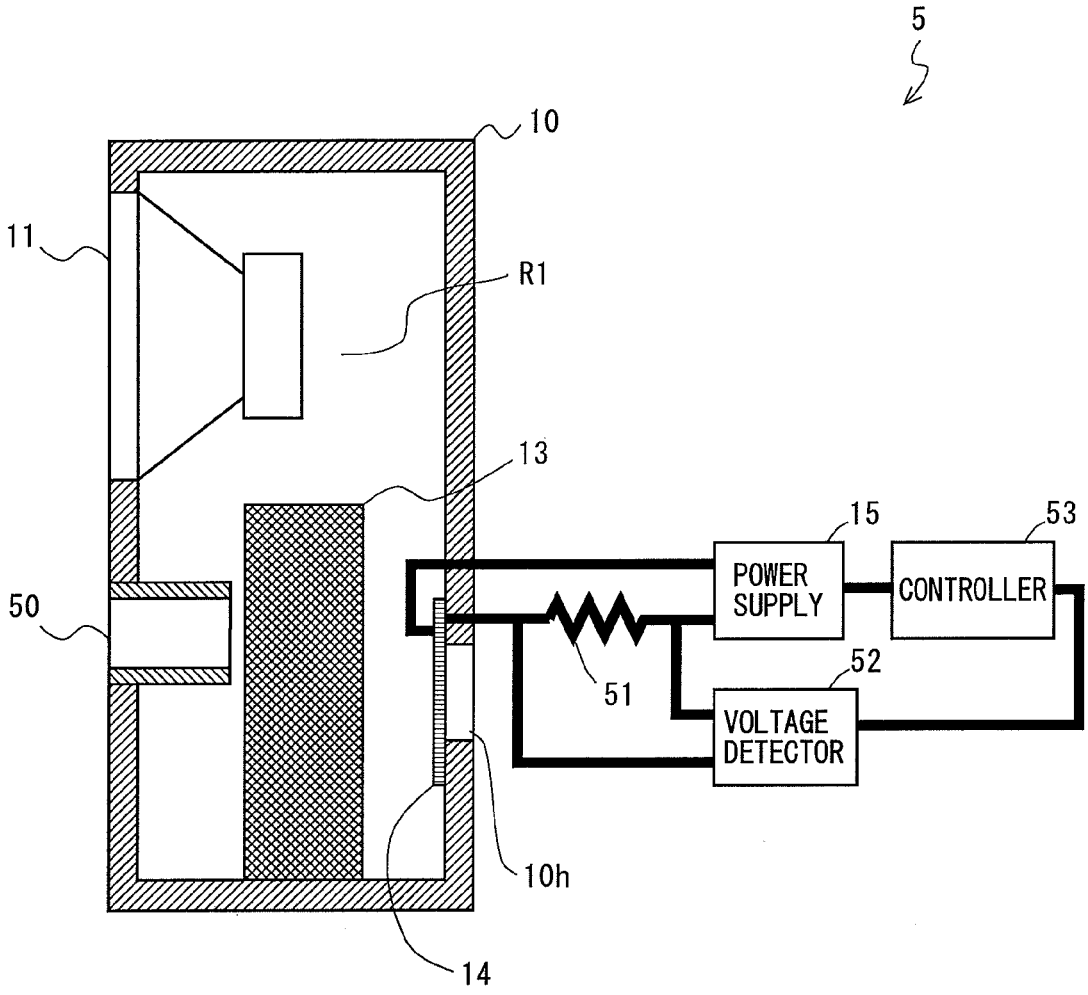
FIG. 7 is a cross-sectional view showing a structure of a loudspeaker system 5.

A structure of a loudspeaker system 5 according to a fifth embodiment of the present invention will be described with reference to FIG. 7. FIG. 7 is a cross-sectional view showing the structure of the loudspeaker system 5. In FIG. 7, the loudspeaker system 5 includes a cabinet 10, a loudspeaker unit 11, a gas adsorber 13, a dehumidifier 14, a power supply 15, an acoustic port 50, an electrical resistance 51, a voltage detector 52, and a controller 53.

The loudspeaker system 5 is different from the loudspeaker system 1 in that the application of a DC voltage of the power supply 15 is controlled, depending on humidity in the inner volume R1. In terms of structure, the loudspeaker system 5 is different from the loudspeaker system 1 only in that the passive radiator 12 is replaced with the acoustic port 50, and the electrical resistance 51, the voltage detector 52 and the controller 53 are further provided. The other parts of the loudspeaker system 5 are the same as those of the loudspeaker system 1, and therefore, and are indicated by the same reference characters and will not be described.

The acoustic port 50 is attached to a front surface of the cabinet 10. The electrical resistance 51 is connected in series to the dehumidifier 14. Specifically, one end of the electrical resistance 51 is electrically connected to an electrode closer to the back surface (the opening 10*h*) of the dehumidifier 14, while the other end is electrically connected to the power supply 15. An electrode closer to the front surface (the inner volume R1) of the dehumidifier 14 is electrically connected via a connection cable directly to the power supply 15. The voltage detector 52 detects a voltage between the terminals of the electrical resistance 51. The voltage detector 52 outputs a detection signal to the controller 53. The controller 53 controls the application of a DC voltage of the power supply 15, depending on the voltage between the terminals of the electrical resistance 51 indicated by the detection signal.

An operation of the loudspeaker system 5 thus configured will be described. When a music signal is applied to the loudspeaker unit 11, a driving force is generated in the voice coil to vibrate the diaphragm, which in turn generates sounds from its front and back surfaces. The sound from the back surface is emitted into the inner volume R1, so that air pressure in the inner volume R1 is changed. However, the gas adsorber 13 is provided in the inner volume R1. Therefore, the physical air adsorption action of the gas adsorber 13 suppresses the change in the air pressure in the inner volume R1, so that the volume of the inside of the inner volume R1 is equivalently increased. Also, the loudspeaker system 5 operates as a bass-reflex type loudspeaker system due to the acoustic port 50, whereby rich low frequency sound can be reproduced.

Here, before describing a control process of the controller 53, a relationship between humidity in the inner volume R1 and a current flowing through the dehumidifier 14 will be described. When the DC voltage is applied to the dehumidifier 14, the current flowing through the dehumidifier 14 increases with an increase in the amount of damp air discharged from the dehumidifier 14 to the outside. In other words, the relationship between the humidity in the inner volume R1 and the current flowing through the dehumidifier 14 is that as the humidity in the inner volume R1 increases, the current flowing through the dehumidifier 14 also increases. This suggests that the humidity in the inner volume R1 can be detected by detecting the current flowing through the dehumidifier 14.

Also, a relationship between the current flowing through the dehumidifier 14 and a voltage between the terminals of the electrical resistance 51 will be described. As the current flowing through the dehumidifier 14 increases, the voltage between the terminals of the electrical resistance 51 also increases. Therefore, the relationship between the current flowing through the dehumidifier 14 and the voltage between the terminals of the electrical resistance 51 is that as the humidity in the inner volume R1 increases, the voltage between the terminals of the electrical resistance 51 also increases. Thus, the voltage detector 52 is used to detect the voltage between the terminals of the electrical resistance 51, thereby detecting the current flowing through the dehumidifier 14, which is converted into the voltage. The detection of the current flowing through the dehumidifier 14 allows detection of the humidity in the inner volume R1.

Figure 8:
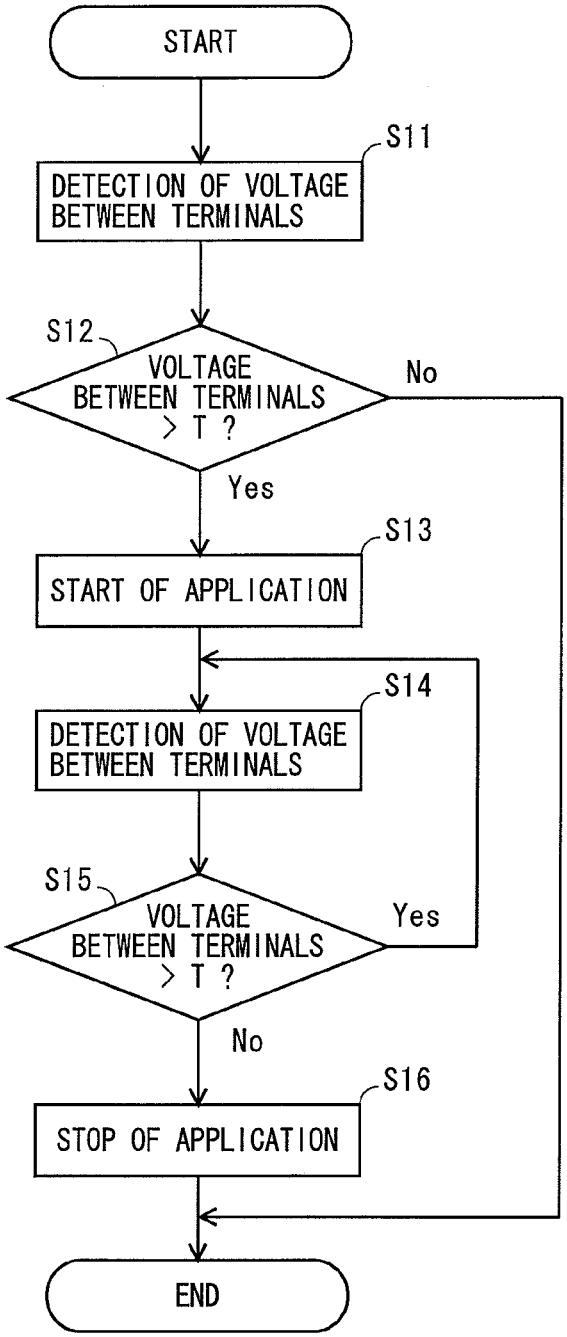
FIG. 8 is a flowchart showing a control process of a controller 53.

Hereinafter, the control process of the controller 53 will be described with reference to FIG. 8. FIG. 8 is a flowchart showing the control process of the controller 53. Note that it is assumed that, in an initial state of FIG. 8, the DC voltage is not applied to the dehumidifier 14. In FIG. 8, the voltage detector 52 detects the voltage between the terminals of the electrical resistance 51 (step S11). Note that it is necessary to apply a DC voltage to the dehumidifier 14 so as to detect the voltage between the terminals of the electrical resistance 51. However, in the initial state, the DC voltage is not applied to the dehumidifier 14. Therefore, here, only at a detection timing of step S11, the controller 53 controls the power supply 15 to apply a DC voltage to the dehumidifier 14.

Next to step S11, the controller 53 determines whether or not the voltage between the terminals of the electrical resistance 51 is larger than a predetermined threshold T (step S12). The voltage between the terminals of the electrical resistance 51 is a voltage depending on the humidity in the inner volume R1 as described above.

When the voltage between the terminals is smaller than or equal to the predetermined threshold T (NO in step S12), the controller 53 determines that the humidity in the inner volume R1 is smaller than or equal to a predetermined threshold, and ends the process.

On the other hand, when the voltage between the terminals is larger than the predetermined threshold T (YES in step S12), the controller 53 determines that the humidity in the inner volume R1 is higher than the predetermined threshold, and starts application of the DC voltage of the power supply 15 (step S13). As a result, damp air in the inner volume R1 starts being discharged through the opening 10*h* to the outside of the cabinet 10 by the dehumidifier 14. After step S13, the voltage detector 52 detects the voltage between the terminals of the electrical resistance 51 (step S14). After step S14, the controller 53 determines whether or not the voltage between the terminals of the electrical resistance 51 is larger than the predetermined threshold T (step S15). When the voltage between the terminals is larger than the predetermined threshold T (YES in step S15), the process returns to step S14. On the other hand, when the amount of damp air in the inner volume R1 is reduced by the dehumidification action of the dehumidifier 14, so that the voltage between the terminals becomes lower than or equal to the predetermined threshold T (NO in step S15), the controller 53 determines that the humidity in the inner volume R1 becomes lower than or equal to the predetermined threshold, and stops the application of the DC voltage of the power supply 15 (step S16). After step S16, the process is ended.

By the process described above, only when the voltage between the terminals is larger than the predetermined threshold T, the DC voltage is applied to the dehumidifier 14, and therefore, damp air in the inner volume R1 is discharged to the outside. Specifically, the controller 53, only when the humidity in the inner volume R1 is higher than the predetermined threshold, controls the power supply 15 to apply a DC voltage to the dehumidifier 14. As a result, the DC voltage can be applied only when it is required, whereby the power consumption of the power supply 15 can be suppressed.

Although the voltage between the terminals of the electrical resistance 51 is detected as the humidity in the inner volume R1 in the control process of FIG. 8, the present invention is not limited to this. Alternatively, a current itself flowing through the dehumidifier 14 may be detected as the humidity in the inner volume R1 without converting the current into a voltage by the electrical resistance 51.

Also, the control process of FIG. 8 may be executed at a timing when the loudspeaker system 5 starts being used, or at predetermined time intervals.

Also, the configuration of the electrical resistance 51, the voltage detector 52 and the controller 53 may be applied to the loudspeaker systems 1 to 4. Particularly, when it is applied to the loudspeaker systems 3 and 4, the amount of damp air in the inner volume R1 is reduced in the loudspeaker systems 3 and 4, and therefore, the power consumption of the power supply 15 is proportionately reduced.

Sixth Embodiment

Figure 9:
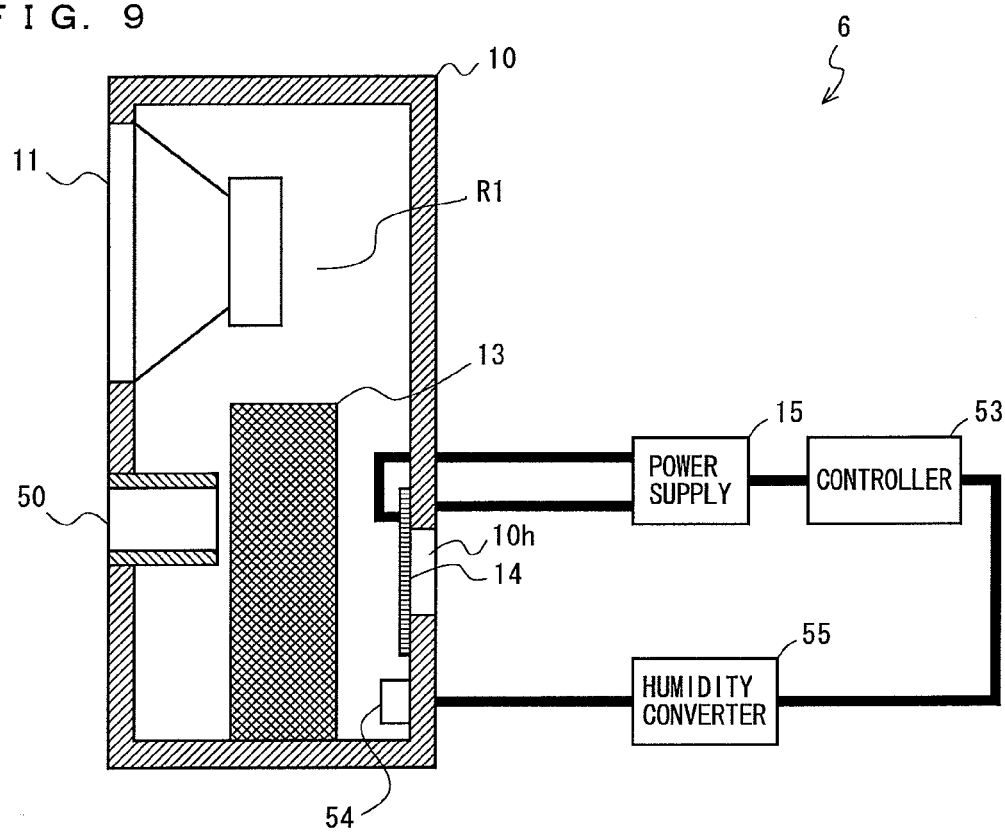
FIG. 9 is a cross-sectional view showing a structure of a loudspeaker system 6.

A structure of a loudspeaker system 6 according to a sixth embodiment of the present invention will be described with reference to FIG. 9. FIG. 9 is a cross-sectional view showing the structure of the loudspeaker system 6. In FIG. 9, the loudspeaker system 6 includes a cabinet 10, a loudspeaker unit 11, a gas adsorber 13, a dehumidifier 14, a power supply 15, an acoustic port 50, a controller 53, a humidity sensor 54, and a humidity converter 55.

The loudspeaker system 6 is different from the loudspeaker system 5 only in that humidity is directly detected using the humidity sensor 54 instead of detecting a current flowing through the dehumidifier 14 or converting the current into a voltage to detect the humidity. In terms of structure, the loudspeaker system 6 is different from the loudspeaker system 5 only in that the electrical resistance 51 and the voltage detector 52 are replaced with the humidity sensor 54 and the humidity converter 55. The other parts of the loudspeaker system 2 are the same as those of the loudspeaker system 5, and therefore, and are indicated by the same reference characters and will not be described.

The humidity sensor 54 detects humidity in the inner volume R1, and outputs a signal having a value of a current corresponding to the detected humidity to the humidity converter 55. The humidity converter 55 converts the value of the current indicated by the signal output from the humidity sensor 54, into a unit (%) of humidity. The controller 53 controls the application of a DC voltage of the power supply 15 based on the humidity whose unit is converted by humidity converter 55.

The control process of the controller 53 in this embodiment is different from that of FIG. 8 only in steps S11, S12, S14 and S15. In this embodiment, the humidity sensor 54 directly detects the humidity in steps S11 and S14. Note that the humidity sensor 54 does not detect a current flowing through the dehumidifier 14. Therefore, at the detection timing in step S11, the controller 53 does not need to cause the power supply 15 to apply a DC voltage to the dehumidifier 14. Also in this embodiment, in steps S12 and S15, the controller 53 determines whether or not the humidity which has been detected by the humidity sensor 54 and whose unit has been converted by the humidity converter 55 is larger than a predetermined threshold. The steps other than steps S11, S12, S14 and S15 are similar to those of the control process of FIG. 8 and will not be described.

Thus, in this embodiment, the humidity sensor 54 is provided, and therefore, the humidity in the inner volume R1 can be more accurately detected than when the humidity is detected based on a current flowing through the dehumidifier 14. As a result, the power supply 15 can be more accurately controlled, whereby the power consumption of the power supply 15 can be further reduced.

Seventh Embodiment

Figure 10:
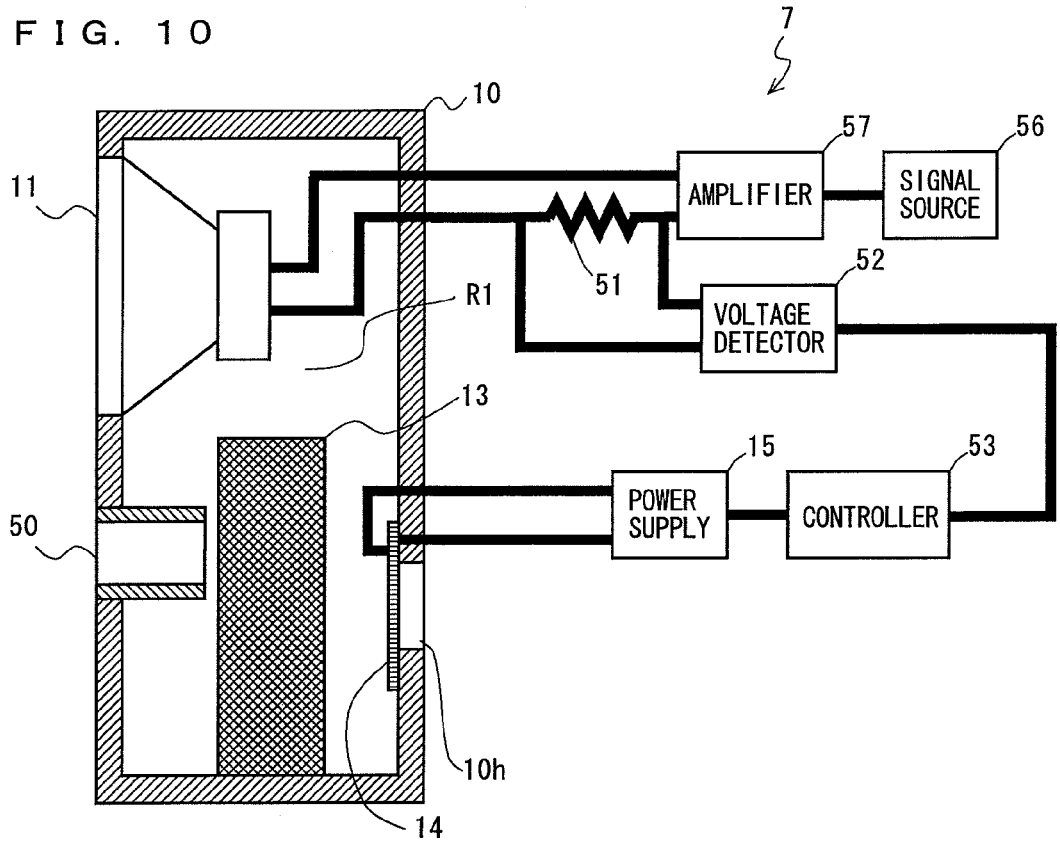
FIG. 10 is a cross-sectional view showing a structure of a loudspeaker system 7.

A structure of a loudspeaker system 7 according to a seventh embodiment of the present invention will be described with reference to FIG. 10. FIG. 10 is a cross-sectional view showing the structure of the loudspeaker system 7. In FIG. 10, the loudspeaker system 7 includes a cabinet 10, a loudspeaker unit 11, a gas adsorber 13, a dehumidifier 14, a power supply 15, an acoustic port 50, an electrical resistance 51, a voltage detector 52, a controller 53, a signal source 56, and an amplifier 57.

The loudspeaker system 7 is different from the loudspeaker system 5 only in that humidity is detected using a frequency characteristic of a current flowing through the loudspeaker unit 11 (hereinafter referred to as a current characteristic) instead of a current flowing through the dehumidifier 14 or a voltage converted from the current. In terms of structure, the loudspeaker system 7 is different from the loudspeaker system 5 only in that the signal source 56 and the amplifier 57 are further provided, and the electrical resistance 51 is provided between the amplifier 57 and the loudspeaker unit 11. The other parts of the loudspeaker system 7 are the same as those of the loudspeaker system 5, and therefore, and are indicated by the same reference characters and will not be described.

The electrical resistance 51 is connected in series to the loudspeaker unit 11. Specifically, one end of the electrical resistance 51 is electrically connected to any one of the input terminals of the loudspeaker unit 11, and the other end is electrically connected to the amplifier 57. The other input terminal of the loudspeaker unit 11 is electrically connected via a connection cable to the amplifier 57. The resistance value of the electrical resistance 51 is assumed to be sufficiently small with respect to the electrical impedance of the loudspeaker unit 11. For example, when the electrical impedance of the loudspeaker unit 11 is 8Ω, the value of the electrical resistance 51 is 0.5Ω or less. When the value of the electrical resistance 51 is sufficiently small, the voltage between the terminals of the electrical resistance 51 can be measured without decreasing a current which flows through the loudspeaker unit 11. In other words, by setting the value of the electrical resistance 51 to be sufficiently small, the current characteristic of the loudspeaker unit 11 can be accurately converted into a voltage, i.e., can be accurately detected.

The signal source 56 generates a measurement signal for measuring the current characteristic of the loudspeaker unit 11. The amplifier 57 amplifies the measurement signal output from the signal source 56 and outputs the resultant signal to the loudspeaker unit 11. The voltage detector 52 detects the voltage between the terminals of the electrical resistance 51 in association with the application of the measurement signal to the loudspeaker unit 11, thereby detecting the current characteristic of the loudspeaker unit 11. The controller 53 controls the application of a DC voltage of the power supply 15 based on the current characteristic of the loudspeaker unit 11 detected by the voltage detector 52.

Figure 11:
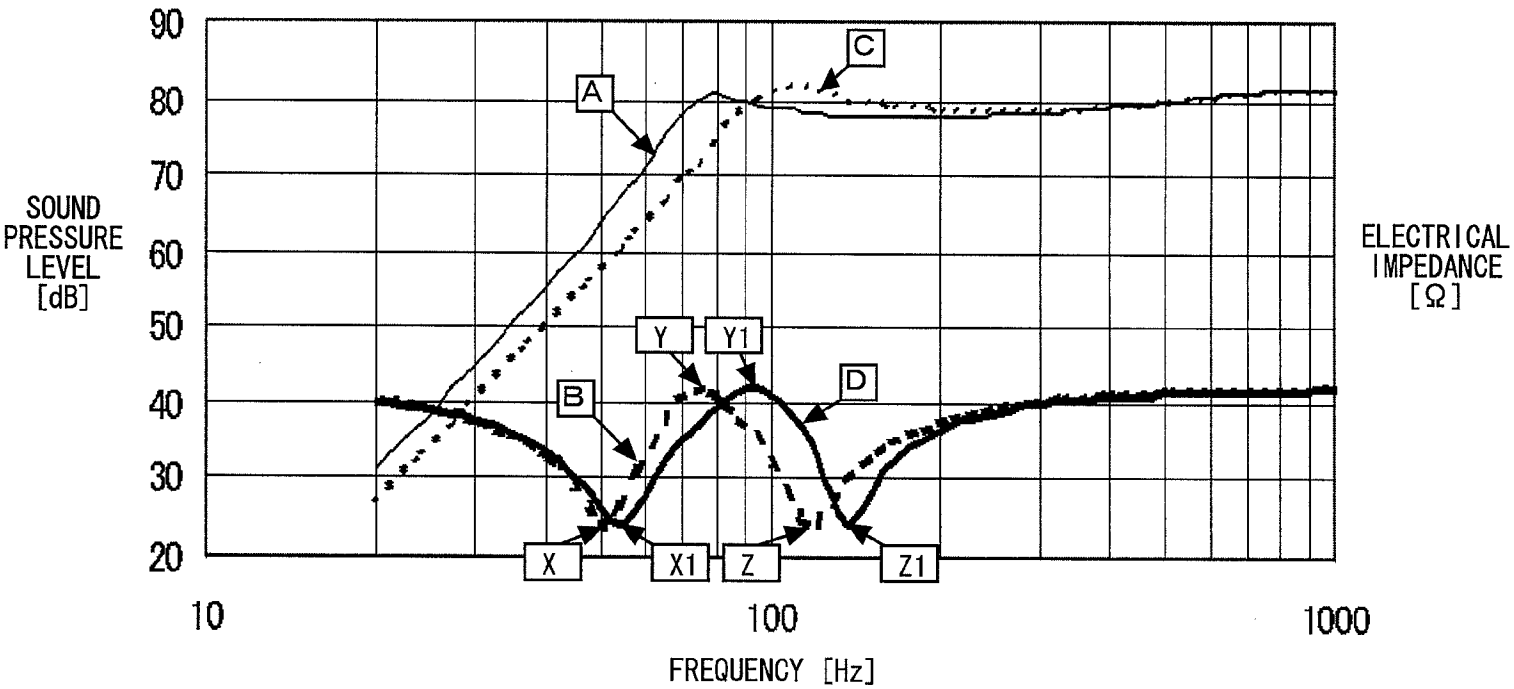
FIG. 11 is a diagram showing sound pressure-frequency characteristics and a current characteristic of a loudspeaker unit 11.

Here, before describing the control process of the controller 53, a relationship between the humidity in the inner volume R1 and the current characteristic of the loudspeaker unit 11 will be described with reference to FIG. 11. FIG. 11 is a diagram showing sound pressure-frequency characteristics and a current characteristic of the loudspeaker unit 11. Note that, in the measurement of FIG. 11, the volume of the inside of the cabinet 10 is 1.3 liter and the diameter of the loudspeaker unit 11 is 8 cm. Graph A in FIG. 11 shows sound pressure-frequency characteristics when the gas adsorber 13 is 60 g of activated carbon having a particle diameter of 0.3 mm. Graph B shows a current characteristic under the same conditions as those of graph A. Graph C shows sound pressure-frequency characteristics when the gas adsorber 13 is not provided. Graph D shows a current characteristic under the same conditions as those of graph C. As can be seen from graphs B and D, there are characteristic crests and troughs in a low frequency region of the current characteristic. Hereinafter, the characteristic crest and trough will be described with reference to graph B. A trough X is a point where the vibration system of the loudspeaker unit 11 affected by the acoustic mass of the acoustic port 50 resonates. A crest Y is a point where acoustic resonance occurs due to the acoustic compliance of the inner volume R1 and the acoustic mass of the acoustic port 50. A trough Z is a point where the vibration system of the loudspeaker unit 11 affected by the acoustic compliance of the inner volume R1 resonates.

Here, graphs B and D are compared. In graph B, as the volume of the inner volume R1 is increased by the gas adsorber 13, the acoustic compliance of the inner volume R1 is equivalently increased. As a result, a frequency of 73.7 Hz at the crest Y is lower than a frequency of 94.5 Hz at a crest Y1 of graph D. Also, the frequency is lower at the trough X than at a trough X1, and the frequency is lower at the trough Z than at a trough Z1. Also, sound pressure is increased at a low frequency sound region in graph A as compared to graph C. For example, at a frequency of 70 Hz, sound pressure in graph A is higher by about 8 dB than that in graph C. Here, a case will be described where external damp air enters through the acoustic port 50 into the inner volume R1, so that the volume increasing effect of the gas adsorber 13 is reduced. In this case, if it is assumed that a current characteristic which is obtained when the gas adsorber 13 is dry corresponds to graph B of FIG. 11, a current characteristic which is obtained when the gas adsorber 13 adsorbs moisture corresponds to graph D. Specifically, as the gas adsorber 13 physically adsorbs damp air, the current characteristic of the loudspeaker unit 11 changes from graph B to graph D. Therefore, by detecting a change in frequency at a resonance point which is any of the crest Y and the troughs X and Z of the current characteristic, the amount of damp air which has an influence on the volume increasing effect of the gas adsorber 13, i.e., the humidity in the inner volume R1 can be detected. For example, a higher frequency at the crest Y indicates a larger amount of damp air which is physically adsorbed by the gas adsorber 13, i.e., the increase of the humidity in the inner volume R1.

Figure 12:
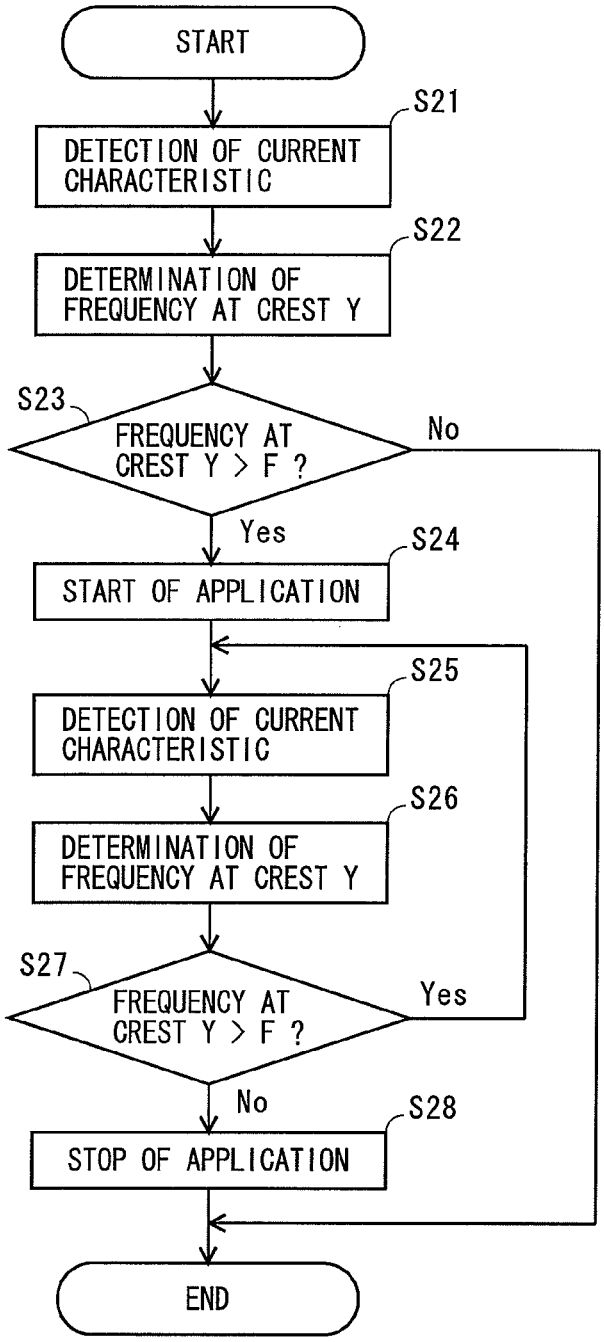
FIG. 12 is a flowchart showing a control process of a controller 53 in a loudspeaker system 7.

A control process of the controller 53 in the loudspeaker system 7 thus configured will be described with reference to FIG. 12. FIG. 12 is a flowchart showing the control process of the controller 53 in the loudspeaker system 7. Note that it is assumed that a DC voltage is not applied to the dehumidifier 14 in the initial state of FIG. 12. In FIG. 12, a measurement signal is input from the signal source 56 via the amplifier 57 to the loudspeaker unit 11. The voltage detector 52 detects the current characteristic of the loudspeaker unit 11 (step S21). The controller 53 determines a frequency at the crest Y of the current characteristic detected in step S21 (step S22). The controller 53 determines whether or not the frequency at the crest Y determined in step S22 is higher than a predetermined threshold F (F is a frequency) (step S23).

When the frequency at the crest Y is lower than or equal to the predetermined threshold F (NO in step S23), the controller 53 determines that humidity in the inner volume R1 is lower than or equal to a predetermined threshold, and ends the process.

On the other hand, when the frequency at the crest Y is higher than the predetermined threshold F (YES in step S23), the controller 53 determines that the humidity in the inner volume R1 is higher than the predetermined value, and starts application of the DC voltage of the power supply 15 (step S24). As a result, damp air in the inner volume R1 starts being discharged through the opening 10*h* to the outside of the cabinet 10 by the dehumidifier 14. After step S24, a measurement signal is input from the signal source 56 via the amplifier 57 to the loudspeaker unit 11, so that the voltage detector 52 detects the current characteristic of the loudspeaker unit 11 (step S25). The controller 53 determines a frequency at the crest Y of the current characteristic detected in step S25 (step S26). The controller 53 determines whether or not the frequency at the crest Y determined in step S26 is higher than the predetermined threshold F (step S27). When the frequency at the crest Y is higher than the predetermined threshold F (YES in step S27), the process returns to step S25. On the other hand, when the dehumidification action of the dehumidifier 14 reduces the amount of damp air in the inner volume R1, so that the frequency at the crest Y becomes lower than or equal to the predetermined threshold F (NO in step S27), the controller 53 determines that the humidity in the inner volume R1 becomes lower than or equal to the predetermined threshold, and stops the application of the DC voltage of the power supply 15 (step S28). After step S28, the process is ended.

By the process described above, the DC voltage is applied to the dehumidifier 14 so that damp air in the inner volume R1 is discharged to the outside only during the time that the frequency at the crest Y is higher than the predetermined threshold F. Specifically, the controller 53, only when the humidity in the inner volume R1 is higher than the predetermined threshold, controls the power supply 15 to apply the DC voltage to the dehumidifier 14. As a result, it is possible to apply the DC voltage only when it is required, whereby the power consumption of the power supply 15 can be suppressed.

Although the frequency at the crest Y is used in FIG. 12, the frequency at the trough X or Z may be used. Of the crest Y and the troughs X and Z, the frequency at the crest Y is most desirable. The trough X is a point where the vibration system of the loudspeaker unit 11 affected by the acoustic mass of the acoustic port 50 resonates. The trough Z is a point where the vibration system of the loudspeaker unit 11 affected by the acoustic compliance of the inner volume R1 resonates. In other words, both the troughs X and Z are a resonance point involved with the vibration system of the loudspeaker unit 11. Therefore, the frequencies at the troughs X and Z are changed as an edge or a damper which are parts of the vibration system of the loudspeaker unit 11 is degraded after long-term use or as a spring force is changed due to the influence of humidity. Alternatively, the frequencies at the troughs X and Z are changed as the diaphragm of the loudspeaker unit 11 absorbs damp air and therefore the weight of the diaphragm is changed. On the other hand, the crest Y is a point where acoustic resonance occurs due to the acoustic compliance of the inner volume R1 and the acoustic mass of the acoustic port 50. In other words, the crest Y is a resonance point which is not involved with the vibration system of the loudspeaker unit 11. Therefore, the frequency at the crest Y is not likely to be changed. Note that, when the changes in the frequencies at the troughs X and Z due to the parts of the vibration system of the loudspeaker unit 11 are small, the frequencies at the troughs X and Z may be used.

Also, although the loudspeaker system 7 is of a bass-reflex type in which the acoustic port 50 is provided in this embodiment, the present invention is not limited to this. The loudspeaker system 7 may be of a bass-reflex type in which a passive radiator is provided instead of the acoustic port 50. In this case, the trough X is a point where the vibration system of the loudspeaker unit 11 affected by the acoustic mass of the passive radiator resonates. The crest Y is a point where acoustic resonance occurs due to the acoustic compliance of the inner volume R1 and the acoustic mass of the passive radiator.

Note that the process of detecting the humidity to control the power supply 15 in the fifth to seventh embodiments may be applied to the loudspeaker systems 1 to 4.

Eighth Embodiment

Figure 13:
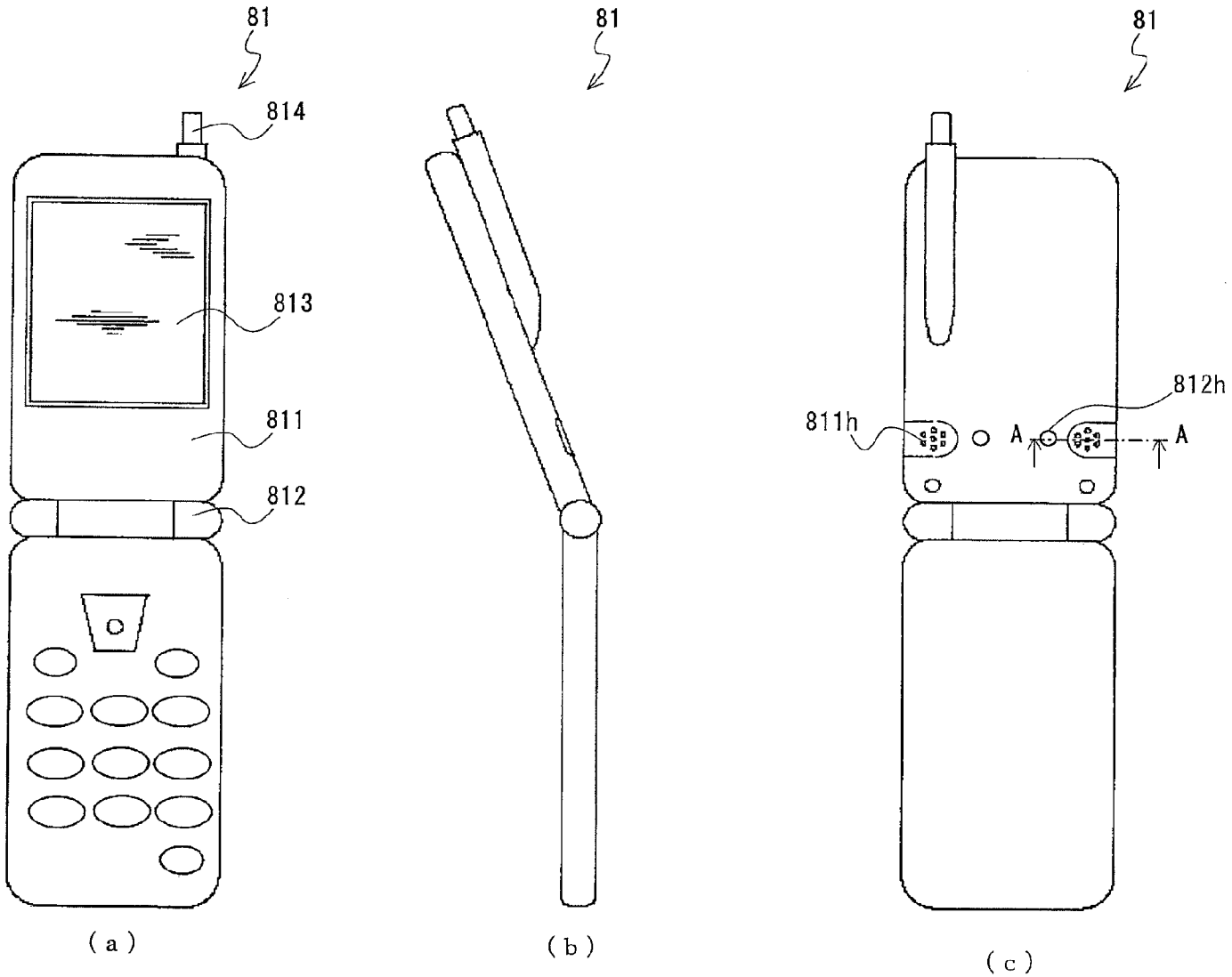
FIG. 13 is an external view of a mobile telephone 81.
Figure 14:
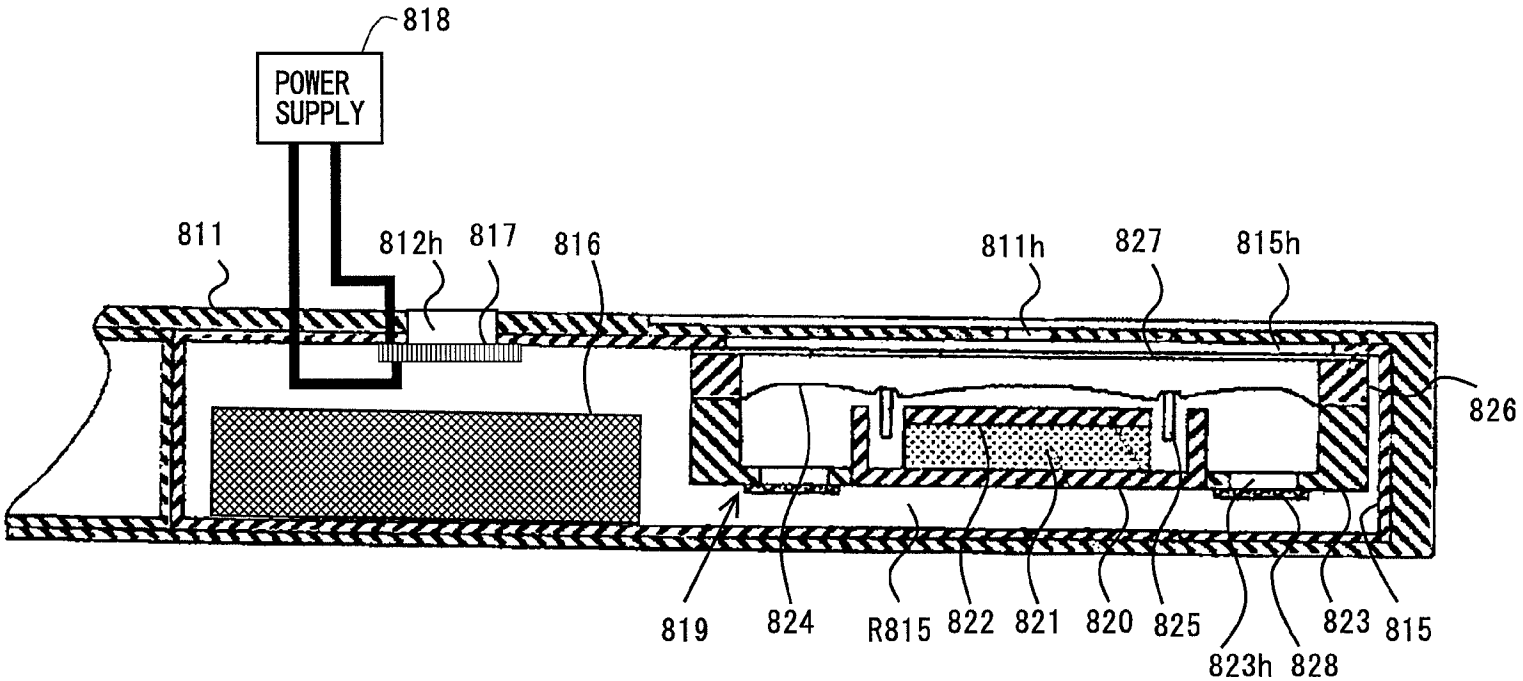
FIG. 14 is a cross-sectional view of a mobile telephone 6, taken along line A-A of FIG. 13(*c*).

The loudspeaker systems 1 to 7 are electronic apparatuses and are applicable to a mobile information processing device, such as a mobile telephone and the like. Other examples of the mobile information processing device include portable apparatuses, such as a portable radio, a portable television, an HDD player, a semiconductor memory player and the like. Hereinafter, a mobile telephone 81 to which the loudspeaker system the present invention is applied will be described as an eighth embodiment with reference to FIGS. 13 and 14. FIG. 13 is an external view of the mobile telephone 81, where (a) is a front view, (b) is a side view, and (c) is a back view. FIG. 14 is a cross-sectional view of the mobile telephone 81, taken along line A-A of FIG. 13(*c*).

The mobile telephone 81 is a flip type mobile telephone. In FIG. 13, the mobile telephone 81 mainly includes a device housing 811, a hinge portion 812, a liquid crystal display 813, and an antenna 814. The liquid crystal display 813 is attached to the device housing 811. As shown in FIG. 13(*c*), openings 811*h* and 812*h* are formed in a back surface of the device housing 811.

The loudspeaker system includes, as shown in FIG. 14, a cabinet 815, a gas adsorber 816, a dehumidifier 817, a power supply 818, and a loudspeaker unit 819. An opening 815*h* is formed in the cabinet 815. The loudspeaker unit 819, which is an electrodynamic loudspeaker, is attached to the opening 815*h* formed in the cabinet 815. The gas adsorber 816, which is the same as the gas adsorber 13 of the first embodiment, is provided in the cabinet 815. The dehumidifier 817, which is the same as the dehumidifier 14 of the first embodiment, is attached to the opening 812*h*. The power supply 818, which is the same as the power supply 15 of the first embodiment, is connected to the dehumidifier 817. Although the power supply 818 is actually provided inside the device housing 811, the power supply 818 is shown outside the device housing 811 in FIG. 14 for the sake of convenience.

The loudspeaker unit 819 includes a yoke 820, a magnet 821, a plate 822, a frame 823, a diaphragm 824, a voice coil 825, a gasket 826, a first dust shielding mesh 827, and a second dust shielding mesh 828. The yoke 820 is fixedly attached to an opening formed in a center of a lower surface of the frame 823 and is integrated with the frame 823. The magnet 821 is fixedly attached to an upper surface of a bottom portion of the yoke 820. The plate 822 is fixedly attached to an upper surface of the magnet 821. An outer periphery of the diaphragm 824 is fixedly attached to an upper surface of an outer periphery of the frame 823. A magnetic gap is formed between the yoke 820 and the plate 822. The voice coil 825 is fixedly attached to a lower surface of the diaphragm 824 so that the voice coil 825 is provided in the magnetic gap. The gasket 826 is fixedly attached to an upper surface of an outer periphery of the diaphragm 824. An outer periphery of the first dust shielding mesh 827 is fixedly attached to an upper surface of the gasket 826. Thus, the gasket 826 is used to prevent the diaphragm 824 from contacting the first dust shielding mesh 827 when the diaphragm 824 vibrates. The second dust shielding mesh 828 is provided on the lower surface of the frame 823 so that the second dust shielding mesh 828 covers a sound hole 823*h* formed in the lower surface of the frame 823.

An operation of the mobile telephone 81 thus configured will be described. The loudspeaker unit 819 is an electrodynamic loudspeaker, whose operation is well known. Therefore, here, an operation of the electrodynamic loudspeaker will be briefly described. The yoke 820, the magnet 821 and the plate 822, which constitute a magnetic circuit, and the voice coil 825 function as a driving force generating means for the loudspeaker unit 819. For example, when the mobile telephone 81 receives a signal through the antenna 814, the received signal is processed as appropriate by a signal processor (not shown) and the like before being input to the loudspeaker unit 819. Thereafter, for example, a melody signal indicating reception of a call is applied to the loudspeaker unit 819, so that a driving force is generated in the voice coil 825. The driving force vibrates the diaphragm 824, which in turn emits melody sounds. The melody sound emitted from an upper surface of the diaphragm 824 passes through the first dust shielding mesh 827 and is then emitted through the openings 811*h* formed in the device housing 811 to the outside of the apparatus. On the other hand, the sound emitted from the lower surface of the diaphragm 824 passes through the sound hole 823*h* and the second dust shielding mesh 828 and is then emitted into an inner volume R815. The sound from the lower surface of the diaphragm 824 changes air pressure in the inner volume R815. However, the gas adsorber 816 is provided in the cabinet 815. Therefore, the physical air adsorption action of the gas adsorber 816 suppresses the change in the air pressure in the inner volume R815. As a result, the volume of the inside of the cabinet 815 is equivalently increased. Also, a DC voltage of the power supply 818 is applied between the electrodes of the dehumidifier 817, so that damp air in the inner volume R815 is discharged through the opening 812*h* to the outside of the cabinet 815.

As described above, by applying the loudspeaker systems 1 to 7 to a mobile information processing device such as a mobile telephone or the like, it is possible to provide a mobile information processing device having a loudspeaker system capable of stably preventing a reduction in the volume increasing effect irrespective ambient humidity.

Note that, in the loudspeaker system of FIGS. 13 and 14, a component for executing a process of controlling a power supply as provided in the loudspeaker systems 5 to 7 may be added. As a result, the loudspeaker system is particularly useful for a mobile information processing device which is typically used in the outside, where ambient humidity is likely to change.

Also, although a closed-box type loudspeaker system is employed in this embodiment, a bass-reflex type loudspeaker system having a passive radiator, an acoustic port or the like may be employed.

Ninth Embodiment

Figure 15:
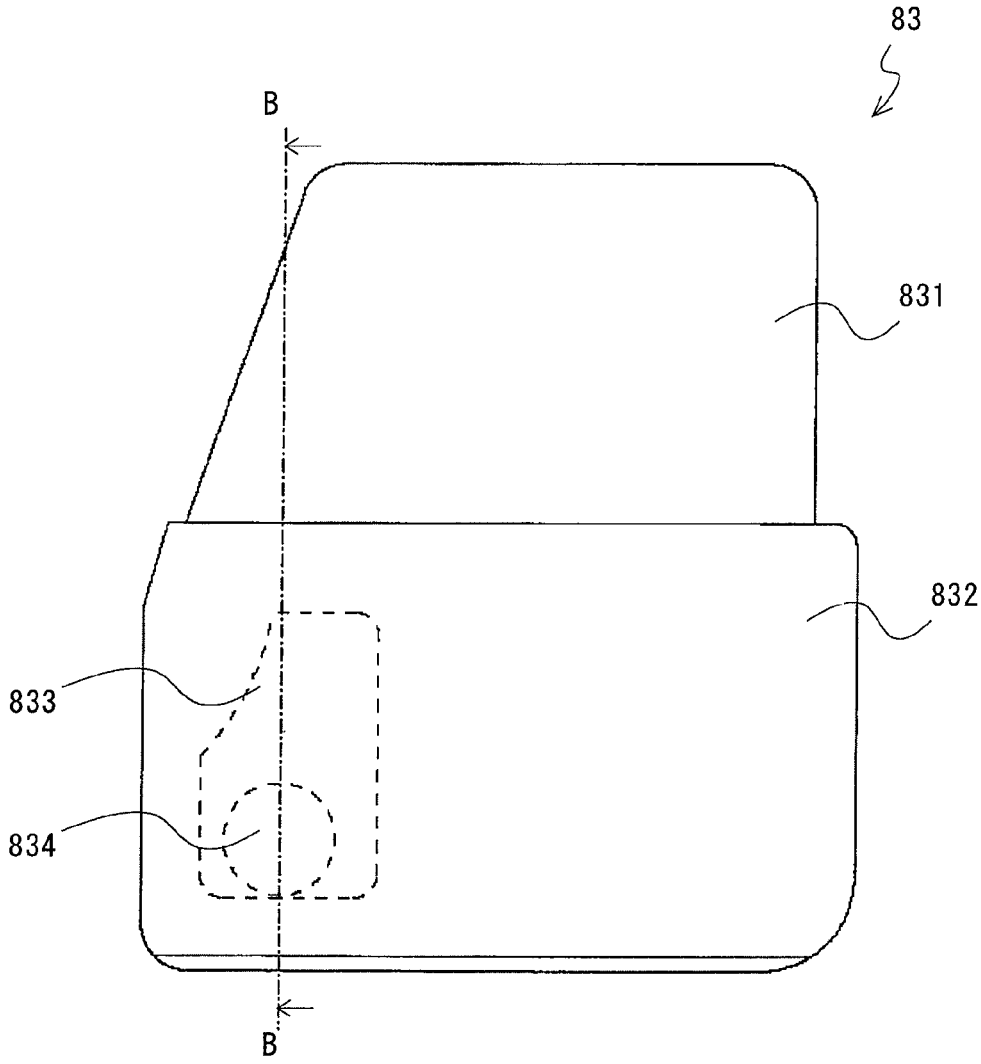
FIG. 15 is an external view of an automobile door 83.
Figure 16:
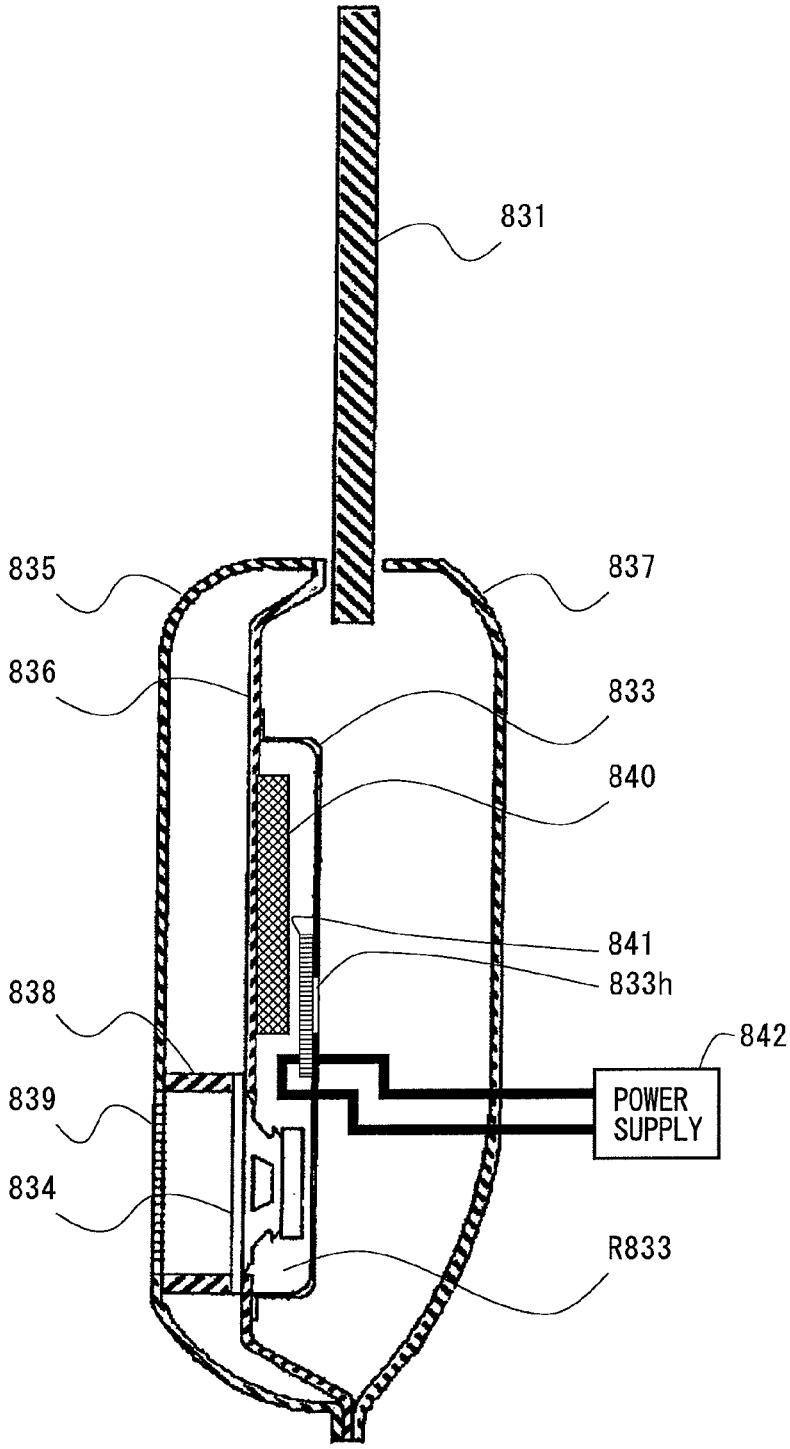
FIG. 16 is a cross-sectional view of an automobile door 83, taken along line B-B of FIG. 15.

The loudspeaker systems 1 to 7 are applicable to a loudspeaker system which is provided in, for example, the body of an automobile. An example of an inner part of an automobile body is a car door. Hereinafter, a door of an automobile to which the loudspeaker system of the present invention is applied will be described as a ninth embodiment with reference to FIGS. 15 and 16. FIG. 15 is an external view of an automobile door 83. FIG. 16 is a cross-sectional view of the automobile door 83, taken along line B-B of FIG. 15.

In FIGS. 15 and 16, the automobile door 83 mainly includes a window glass 831 and a door main body 832. The door main body 832 includes a cabinet 833, a loudspeaker unit 834, an inner wall 835, an inner panel 836, an outer panel 837, an acoustic tube 838, a grille 839, a gas adsorber 840, and a dehumidifier 841. Although a power supply 842 is provided in the automobile, the power supply 842 is shown as a block in FIG. 16 for the sake of convenience.

The window glass 831 is provided between the inner panel 836 and the outer panel 837 so that the window glass 831 can be moved vertically. The inner panel 836 is provided between the inner wall 835 and the outer panel 837. An opening having almost the same size as that of the loudspeaker unit 834 is formed in the inner panel 836, and the loudspeaker unit 834 is attached to the inner panel 836 by fitting to the opening. The loudspeaker unit 834 is, for example, an electrodynamic loudspeaker. The front surface of the loudspeaker unit 834 faces the inner wall 835. The grille 839 is attached to an opening formed in the inner wall 835. One end of the acoustic tube 838 is attached to an outer periphery of the front surface of the loudspeaker unit 834, while the other end of the acoustic tube 838 is attached to an outer periphery of the opening formed in the inner wall 835. As a result, a space is formed in front of the loudspeaker unit 834 by an inner surface of the acoustic tube 838 and the grille 839.

The cabinet 833 is in the shape of a box having one open face. The cabinet 833 is provided in a space between the inner panel 836 and the outer panel 837, and is attached to the inner panel 836, surrounding the loudspeaker unit 834. The gas adsorber 840, which is the same as the gas adsorber 13 of the first embodiment, is provided in an inner volume R833. The dehumidifier 841, which is the same as the dehumidifier 14 of the first embodiment, is attached to an opening 833*h*. The power supply 842, which is the same as the power supply 15 of the first embodiment, is connected to the dehumidifier 841.

An operation of the loudspeaker system provided in the automobile door 83 thus configured will be described. When a music signal is applied from an audio apparatus (not shown) such as a CD player or the like which is provided in the automobile body to the loudspeaker unit 834, sounds are emitted from the front and back surfaces of the loudspeaker unit 834. Of the sounds, the sound from the back surface of the loudspeaker unit 834 is emitted into the inner volume R833. The sound from the back surface of the loudspeaker unit 834 changes air pressure in the inner volume R833. However, the gas adsorber 840 is provided in the cabinet 833. The change in the air pressure in the inner volume R833 is suppressed by the physical adsorption action of the gas adsorber 840. As a result, the volume of the inside of the cabinet 833 is equivalently increased. Also, a DC voltage of the power supply 842 is applied between the electrodes of the dehumidifier 841, so that damp air in the inner volume R833 is discharged through the opening 833*h* to the outside of the cabinet 833.

As described above, by employing the loudspeaker systems 1 to 7 in the automobile body, it is possible to provide an automobile having a loudspeaker system capable of stably preventing a reduction in the volume increasing effect irrespective ambient humidity.

Although the loudspeaker system is provided in the automobile door 83 as an example in this embodiment, the present invention is not limited to this. The loudspeaker system may be provided in a front panel, a rear tray, a ceiling of an automobile body, or the like.

Also, in this embodiment, a component for executing a process of controlling a power supply as provided in the loudspeaker systems 5 to 7 may be added. As a result, the loudspeaker system is particularly useful for automobiles, in which ambient humidity is likely to change.

Also, although a closed-box type loudspeaker system is employed in this embodiment, a bass-reflex type loudspeaker system having a passive radiator, an acoustic port or the like may be employed.

Tenth Embodiment

Figure 17:
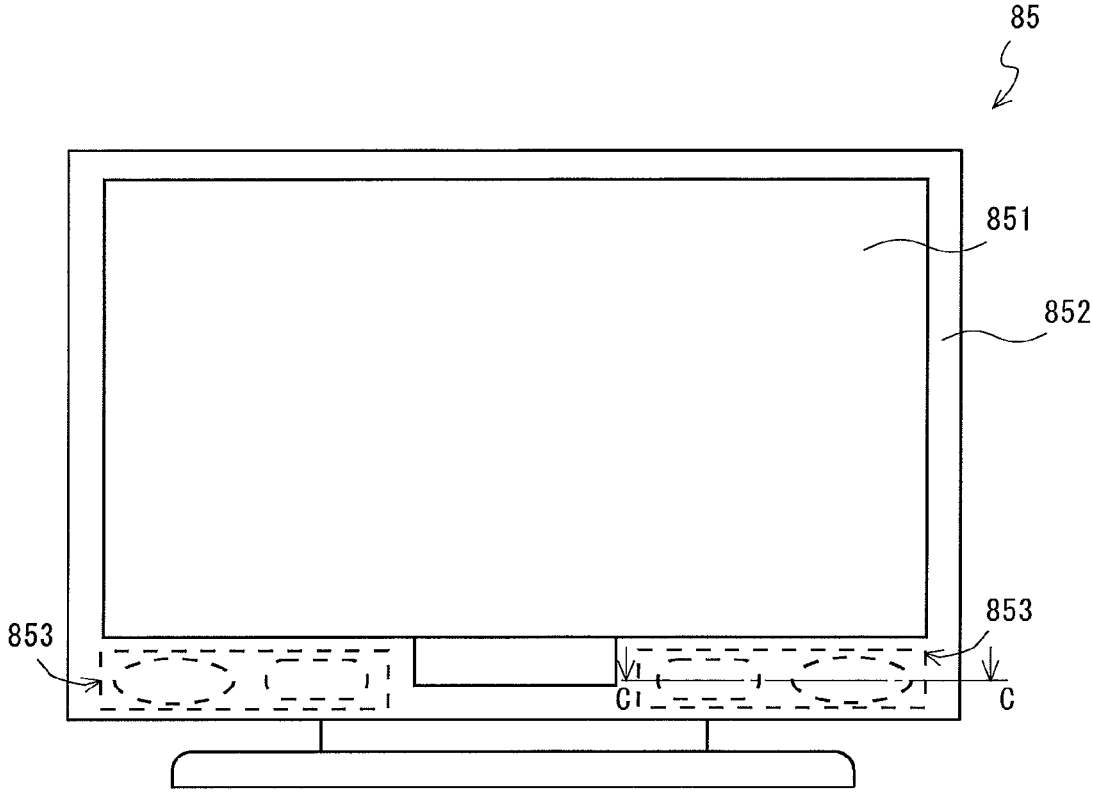
FIG. 17 is a front view of a flat-panel television 85.
Figure 18:
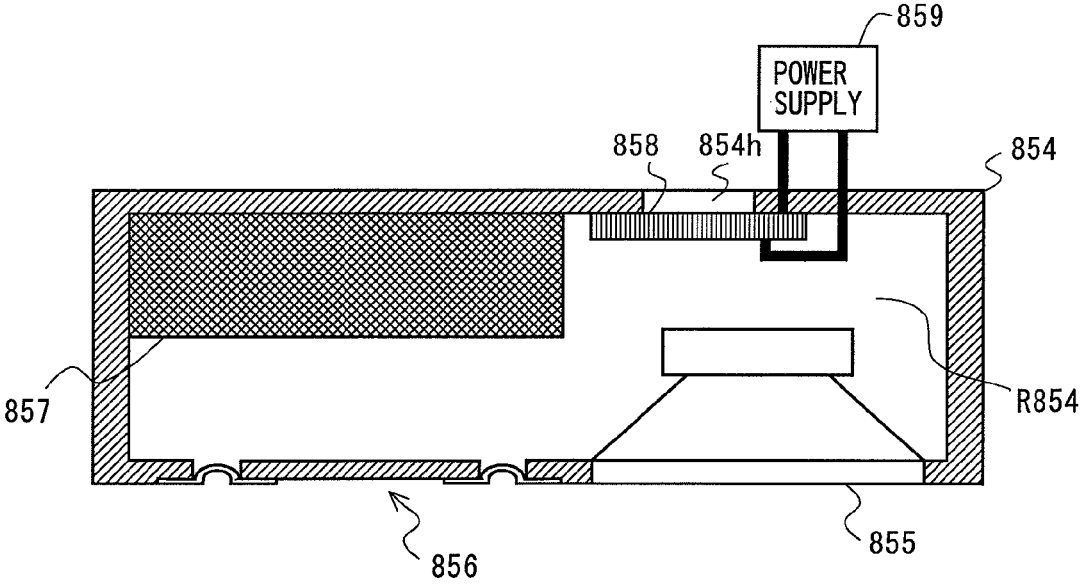
FIG. 18 is a cross-sectional view of a loudspeaker system 853, taken along line C-C of FIG. 17.
Figure 19:
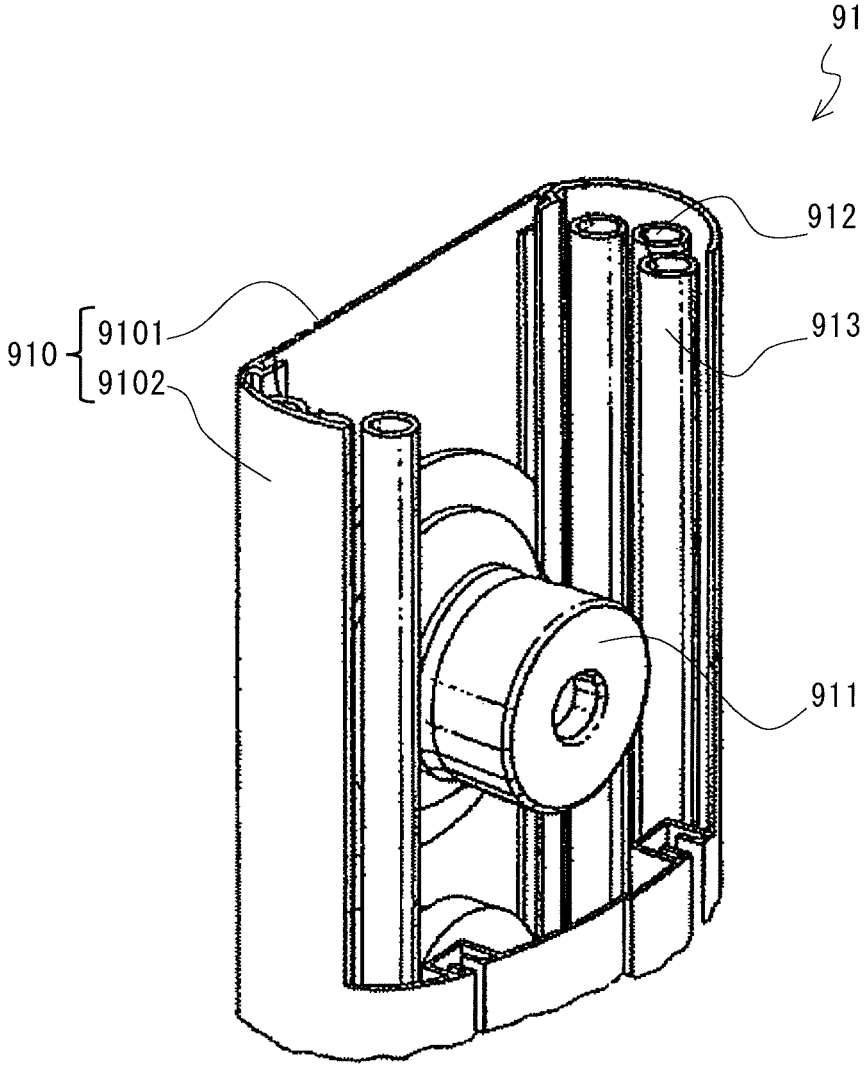
FIG. 19 PRIOR ART
FIG. 19 is a partial cross-sectional view showing a main portion of a loudspeaker system 91 disclosed in Patent Document 1.
Figure 20:
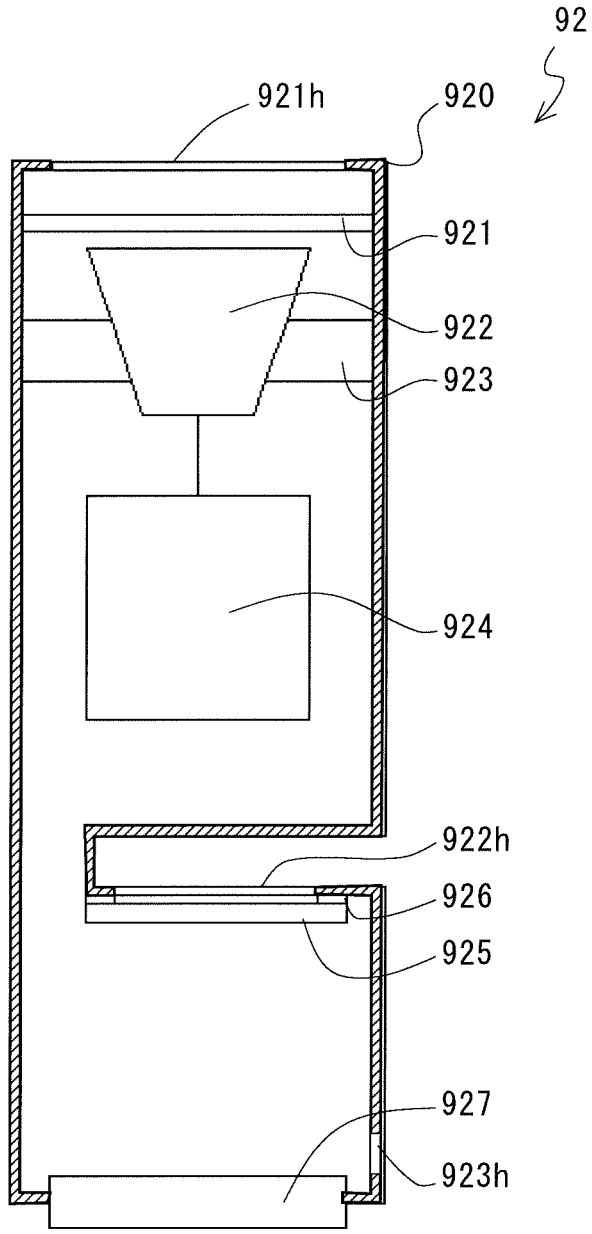
FIG. 20 PRIOR ART
FIG. 20 is a cross-sectional view showing a structure of a microphone device 92 disclosed in Patent Document 2.

The loudspeaker systems 1 to 7 are electronic apparatuses and are applicable to a loudspeaker system provided in a video apparatus, such as a flat-panel television or the like. Hereinafter, a flat-panel television to which the loudspeaker system of the present invention is applied will be described as a tenth embodiment with respect to FIGS. 17 and 18. FIG. 17 is a front view of the flat-panel television 85. FIG. 18 is a cross-sectional view of the loudspeaker system 853, taken along line C-C of FIG. 17.

In FIG. 17, the flat-panel television 85 includes a liquid crystal display 851, an apparatus housing 852, and two loudspeaker systems 853. The loudspeaker system 853 is provided in the apparatus housing 852. Specifically, the loudspeaker system 853 is provided below the liquid crystal display 851. In FIG. 18, the loudspeaker system 853 includes a cabinet 854, a loudspeaker unit 855, a passive radiator 856, a gas adsorber 856, a dehumidifier 858, and a power supply 859. The loudspeaker unit 855, which is, for example, an electrodynamic loudspeaker, is attached to the cabinet 854. The passive radiator 856 is attached to the cabinet 854. The gas adsorber 856, which is the same as the gas adsorber 13 of the first embodiment, is provided in the cabinet 854. The dehumidifier 858, which is the same as the dehumidifier 14 of the first embodiment, is attached to an opening 854*h*. The power supply 859, which is the same as the power supply 15 of the first embodiment, is connected to the dehumidifier 858.

An operation of the loudspeaker system provided in the flat-panel television 85 thus configured will be described. When an acoustic signal is applied from an audio circuit (not shown) to the loudspeaker unit 855, sounds are emitted from the front and back surfaces of the loudspeaker unit 855. Of the sounds, the sound from the back surface of the loudspeaker unit 855 is emitted into an inner volume R854. The sound from the back surface of the loudspeaker unit 855 changes air pressure in the inner volume R854. However, the gas adsorber 856 is provided in the cabinet 854. Therefore, the change in the air pressure in the inner volume R854 is suppressed by the physical adsorption action of the gas adsorber 856. As a result, the volume of the inside of the cabinet 854 is equivalently increased. Also, a DC voltage of the power supply 859 is applied between the electrodes of the dehumidifier 858, so that damp air in the inner volume R854 is discharged through the opening 854*h* to the outside of the cabinet 854.

As described above, by applying the loudspeaker systems 1 to 7 to a video apparatus, it is possible to provide a video apparatus having a loudspeaker system capable of stably preventing a reduction in the volume increasing effect irrespective ambient humidity. Also, the volume of the cabinet is becoming a factor which hinders a reduction in thickness or size of a flat-panel television, such as a liquid crystal, a PDP (plasma display) or the like, and therefore, the loudspeaker system of this embodiment is particularly effective.

Note that, in the loudspeaker system of FIGS. 17 and 18, a component for executing a process of controlling a power supply as provided in the loudspeaker systems 5 to 7 may be added. As a result, the loudspeaker system is particularly useful for video apparatuses, in which ambient humidity is likely to change when a humidifier is used at its installed place.

Although the loudspeaker system 853 is provided below the liquid crystal display 851 in this embodiment, the loudspeaker system 853 may be provided on both the right and left sides of the liquid crystal display 851.

Although the loudspeaker unit is an electrodynamic loudspeaker in the first to tenth embodiments, the loudspeaker unit may be a piezoelectric loudspeaker, an electrostatic loudspeaker, an electromagnetic loudspeaker or the like.

Also, it has been described in the first to tenth embodiments that a dehumidifier is employed in a loudspeaker system including a gas adsorber. Even if a dehumidifier is employed in a loudspeaker system which does not includes a gas adsorber, a vibration system member of the loudspeaker unit adsorbs moisture, whereby a degradation in sound quality can be prevented.

Also, the combination of a gas adsorber, a dehumidifier and a power supply described in the first to tenth embodiments can be utilized as a building component for absorbing or shielding sound.

INDUSTRIAL APPLICABILITY

The loudspeaker system of the present invention can stably prevent a reduction in the volume increasing effect irrespective ambient humidity, and is applicable to liquid crystal televisions, PDPs, stereo apparatuses, in-car apparatuses, mobile information processing devices and the like.

The invention claimed is:

1. A loudspeaker system comprising:

a cabinet; a first opening formed in the cabinet; a second opening formed in the cabinet;

a loudspeaker unit attached to the first opening formed in the cabinet; a gas absorber provided in the cabinet, and being configured to physically adsorb gas in the cabinet to equivalently increase a volume of an inside of the cabinet; a dehumidifier attached to the second opening formed in the cabinet, and being configured to discharge damp air in the cabinet to the outside when a DC voltage is applied thereto; a power supply configured to apply the DC voltage to the dehumidifier; a cover unit configured and arranged to cover the dehumidifier to form a first space inside the cabinet; and a third opening arranged in the cover unit so as to enable communication between a second space which is formed inside the cabinet and the first space formed by the cover unit;

a humidity detector configured to detect humidity in the cabinet; and a controller configured to control the power supply to apply the DC voltage to the dehumidifier only when the humidity detected by the humidity detector is higher than a predetermined threshold, wherein the humidity detector is configured to detect a frequency characteristic of a current flowing through the loudspeaker unit, and the controller controls the power supply to apply the DC voltage to the dehumidifier only when a frequency at a predetermined resonance point included in the frequency characteristic is higher than a predetermined threshold.

2. The loudspeaker system according to claim 1, further comprising:

a cushion member fixedly attached to at least a portion of the dehumidifier, and being permeable to air.

3. The loudspeaker system according to claim 1, wherein the cushion member is foam rubber.

4. The loudspeaker system according to claim 1, wherein the cushion member is shaped in a plate or a grid.

5. The loudspeaker system according to claim 1, wherein the gas absorber includes a porous material made of at least any one of activated carbon, zeolite, silica ($SiO_2$), alumina ($Al_2O_3$), zirconia ($ZrO_3$), magnesia (MgO), triiron tetroxide ($Fe_3O_4$), molecular sieve, fullerene, and carbon nanotube.

6. The loudspeaker system according to claim 1, wherein the humidity detector includes an electrical resistance connected in series to the dehumidifier, and a voltage detector configured to detect a voltage between terminals of the electrical resistance, thereby detecting the frequency characteristic, wherein the frequency characteristic is converted into the voltage.

7. The loudspeaker system according to claim 1, further comprising:

an acoustic port attached to the cabinet, and being configured to acoustically connect an inside and an outside of the cabinet, wherein the predetermined resonance point is a point where acoustic resonance occurs due to an acoustic mass of the acoustic port and an acoustic compliance of an inner volume in the cabinet.

8. The loudspeaker system according to claim 1, further comprising:

a passive radiator attached to a third opening formed in the cabinet, wherein the predetermined resonance point is a point where acoustic resonance occurs due to an acoustic mass of the passive radiator and an acoustic compliance of an inner volume in the cabinet.

9. A vehicle comprising:

the loudspeaker system according to claim 1; and a body in which the loudspeaker system is provided.

10. A vehicle comprising:

the loudspeaker system according to claim 6; and a body in which the loudspeaker system is provided.

11. A vehicle comprising:

the loudspeaker system according to claim 7; and a body in which the loudspeaker system is provided.

12. A vehicle comprising:

the loudspeaker system according to claim 8; and a body in which the loudspeaker system is provided.

13. A video apparatus comprising:

the loudspeaker system according to claim 1; and an apparatus housing in which the loudspeaker system is provided.

14. A video apparatus comprising:

the loudspeaker system according to claim 6; and an apparatus housing in which the loudspeaker system is provided.

15. A video apparatus comprising:

the loudspeaker system according to claim 7; and an apparatus housing in which the loudspeaker system is provided.

16. A video apparatus comprising:
the loudspeaker system according to claim 8; and
an apparatus housing in which the loudspeaker system is provided.

17. A mobile information processing device comprising:
the loudspeaker system according to claim 1; and
a device housing in which the loudspeaker system is provided.

18. A mobile information processing device comprising:
the loudspeaker system according to claim 6; and
a device housing in which the loudspeaker system is provided.

19. A mobile information processing device comprising:
the loudspeaker system according to claim 7; and
a device housing in which the loudspeaker system is provided.

20. A mobile information processing device comprising:
the loudspeaker system according to claim 8; and
a device housing in which the loudspeaker system is provided.

* * * * *